US005765709A

United States Patent [19]

Scott

[11] Patent Number: 5,765,709

[45] Date of Patent: Jun. 16, 1998

[54] CONTAINER END PIECE WITH OPENABLE PANEL DEFINED BY PRODUCT-SIDE SCORE WITH POST REPAIR MATERIAL RESERVOIR

[75] Inventor: Dana H. Scott, Thornton, Colo.

[73] Assignee: Ball Corporation, Muncie, Ind.

[21] Appl. No.: 692,076

[22] Filed: Aug. 7, 1996

[51] Int. Cl.[6] ..... B65D 41/32

[52] U.S. Cl. ..... 220/268; 220/266

[58] Field of Search ..... 220/615, 266, 220/268, 270, 274, 276, 277

[56] References Cited

U.S. PATENT DOCUMENTS

| | | | |
|---|---|---|---|
| D. 26,377 | 12/1896 | Meier . | |
| 1,183,728 | 5/1916 | Griffith . | |
| 2,090,749 | 8/1937 | Corsl et al. | 215/11 |
| 2,093,730 | 9/1937 | Kurkjian | 128/252 |
| 2,519,986 | 8/1950 | Trout | 215/11 |
| 2,628,908 | 2/1953 | Horan | 99/171 |
| 2,628,910 | 2/1953 | Horan | 99/171 |
| 2,630,932 | 3/1953 | Lestakis | 215/11 |
| 2,741,396 | 4/1956 | Lobl | 220/60 |
| 2,796,062 | 6/1957 | Tupper | 128/252 |
| 2,805,663 | 9/1957 | Robinson et al. | 128/252 |
| 2,843,281 | 7/1958 | Gallois | 215/11 |
| 3,082,770 | 3/1963 | Straub | 128/252 |
| 3,159,297 | 12/1964 | Searer | 215/11 |
| 3,253,753 | 5/1966 | Barton et al. | 222/547 |
| 3,794,206 | 2/1974 | De Line et al. | 220/268 |
| 3,881,437 | 5/1975 | Lovell et al. | 113/121 C |
| 3,881,630 | 5/1975 | Lovell et al. | 220/268 |
| 3,902,626 | 9/1975 | Jordan et al. | 220/266 X |
| 4,258,859 | 3/1981 | Westphal | 220/266 X |
| 4,909,407 | 3/1990 | Lambert et al. | 220/268 |
| 4,976,368 | 12/1990 | Klein | 220/268 |
| 5,071,042 | 12/1991 | Esposito | 222/570 |
| 5,346,087 | 9/1994 | Klein | 220/268 |

*Primary Examiner*—Steven M. Pollard
*Attorney, Agent, or Firm*—Sheridan Ross P.C.

[57] ABSTRACT

An end piece for a drawn and ironed container is disclosed. The end piece has a score which defines an openable section for accessing the contents of the container. The score includes at least one reservoir for post repair material which is deposited into the main portion of the score while the end piece is rotated. The reservoir functions to receive post repair material which is forced out of the main portion of the score during this rotation of the end piece and/or to actually generate forces which counteract the centrifugal forces exerted on the post repair material such that it is retained within the main portion of the score.

20 Claims, 22 Drawing Sheets

CONTAINER END PIECE WITH OPENABLE PANEL DEFINED BY PRODUCT-SIDE SCORE WITH POST REPAIR MATERIAL RESERVOIR

FIELD OF THE INVENTION

The present invention generally relates to a container end piece which is attachable to an open end of a container body and, more particularly, to a container end piece having an openable section defined by a score on the product side of the end piece which includes a post repair material reservoir.

BACKGROUND OF THE INVENTION

Significant efforts have been expended by drawn and ironed beverage container producers to gain a competitive advantage within the industry. For instance, efforts have been and continue to be directed to designing containers formed from thinner sheet metal stock to reduce material and thus overall production costs. Relatedly, efforts have concentrated on improving the performance of the container, such as maintaining sufficient strength characteristics which are often imposed by the beverage fillers when using the noted thinner sheet metal stocks (e.g., end piece buckle strength, static dome reversal strength, drop resistance of the dome). Increases in production rates can also, of course, reduce per unit production costs.

SUMMARY OF THE INVENTION

The present invention is generally directed to a container end piece which is attachable to an open end of a container body. The end piece is detachably connectable to the container body and includes an openable section or a push-down panel for accessing the contents of the container which includes the end piece attached to a container body. Structure is typically provided on an upper surface of the end piece for engagement by a user to assist in the separation of at least a portion of the openable section from a remainder of the end piece for accessing the contents of the container. This surface is typically referred to as the "public side" of the container end piece since this defines the exterior surface of the container end piece when attached to the container body and does not interface with the product within the container.

Effective separation of the openable section from the remainder of the end piece is affected by a score which is disposed on the "product side" of the container end piece. The "product side" is that side of the container end piece which interfaces with the contents of the container. Preferably, a portion of the perimeter of the opening panel remains unscored to define a hinged connection between the openable panel and the remainder of the end piece such that, after opening, the openable panel remains attached to the end piece to at least some extent.

A post repair material is included within the above-described score to protect the material forming the end piece from the contents of the container and to also seal this portion in the region of the score of the end piece. This post repair material is deposited within the score by rotating the container end piece relative to an appropriate post repair material depositing device. Since post repair material deposited within the score is exposed to centrifugal forces by rotation of the container end piece, the above-noted score on the product side of the end piece includes a reservoir disposed adjacent to and interfacing with the score on at least the radially outermost portion thereof. This reservoir will typically extend the entire length of the score (e.g., it will have the same arcuate extent as the score) and may also be considered as that part of the score which is disposed closest to the lower surface of the end piece and most radially outward. Functionally, the reservoir provides a place for post repair material to flow radially outwardly from the main portion of the score due to rotation of the container end piece, and yet still have such post repair material interface with the major portion of the score after rotation is terminated (e.g., by allowing post repair material to flow from the reservoir back into the score after rotation of the container end piece is terminated), and/or actually generates forces which counteract the noted centrifugal forces to retain the post repair material within the major portion of the score during rotation of the container end piece (e.g., the reservoir may be viewed as providing a barrier to outward movement of the post repair material from the major portion of the score during rotation of the container end piece and during post repair material deposition operations). The reservoir thereby enhances the control for post repair material being retained within the major portion of the score such that the major portion of the score is effectively sealed against leakage and corrosion.

Based upon the foregoing, it should be appreciated that principles of the present invention are not restricted to use with only specific types of end piece configurations. That is, principles of the present invention may be utilized with "cone-top" end pieces which have a generally frustumly-shaped outer panel with a generally column-like crown extending vertically upwardly from this outer panel, such as by incorporating the above-described openable panel on an upper portion of this crown. Principles of the present invention may also be used with conventional end pieces which have a substantially planar panel on which the above-described openable panel could be incorporated.

DETAILED DESCRIPTION

Figure 1:
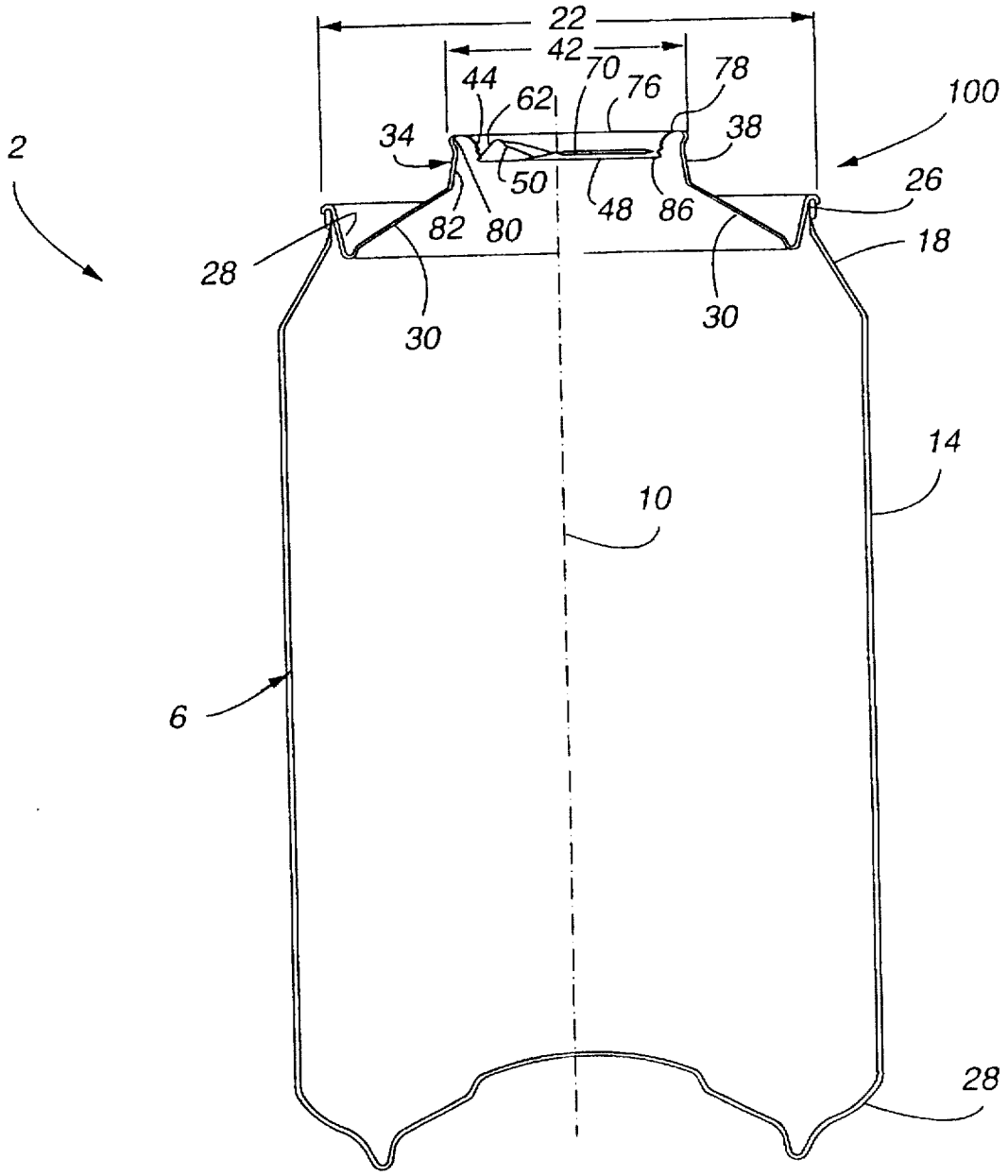
FIG. 1 is a cross-sectional view of a drawn and ironed container with end piece attached according to the present invention.
Figure 2:
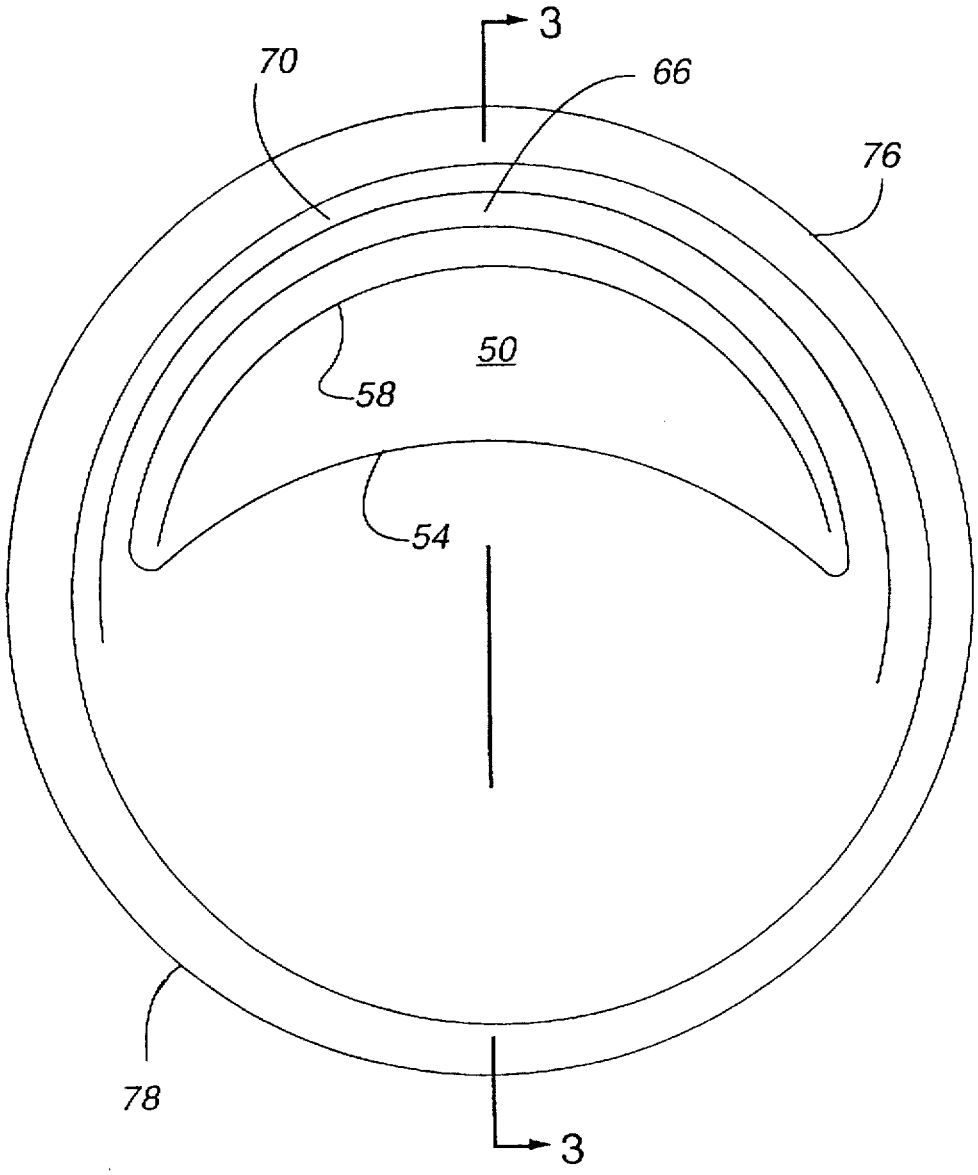
FIG. 2 is a top view of one embodiment of a container end piece on the container of FIG. 1.
Figure 3:
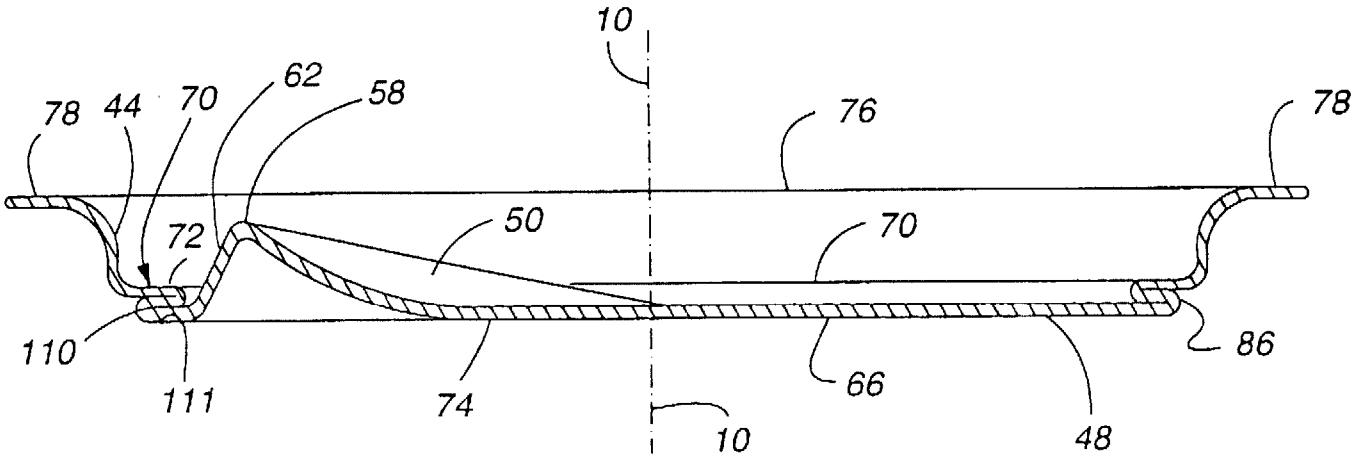
FIG. 3 is a cross-sectional view of the end piece of FIG. 2 taken along line 3—3.

The present invention will be described in relation to the accompanying drawings which assist in illustrating the various features of the invention. Referring to FIGS. 1–3, a container end piece which may incorporate principles of the present invention is illustrated as being attached to a drawn and ironed container body. Although the end piece is illustrated as being part of a two-piece container design, it should be appreciated that principles of the present invention may be utilized in three-piece designs as well. Moreover, it should be appreciated that principles of the present invention are not dependent upon the configuration of the end piece itself (e.g., such that the present invention may be incorporated into an end piece which is substantially planar).

A metal, drawn and ironed container 2 is illustrated in FIG. 1 and generally includes a container body 6 and an end piece 100 which is separately attached thereto. The container body 6 includes a sidewall 14 (e.g., a smooth cylindrical surface, a generally cylindrical surface with ribs or flutes, etc.) which is disposed circumferentially about a central axis 10. A tapered in neck 18 is formed on the upper end of the sidewall 14 to allow, for instance, for the reduction of the diameter of the end piece 100 attached thereto. A bottom 28 is integrally formed with the lower portion of the sidewall 14 (i.e., such that the container body 6 is an integral piece or of one-piece construction).

Referring to FIGS. 1–3, the end piece 100 is of one-piece construction and is separately attached to the upper part of the neck 18 of the container body 6, such as by seaming. The seaming operation defines an annular standing seam 26 which has a seam diameter 22 (more typically referred to as the neck diameter since it is also effectively the diameter of the uppermost portion of the neck 18). An annular transition section 28 extends downwardly from the seam 26 toward the central axis 10. A skirt or apron 30 is interconnected with the transition section 28 by an arcuate portion and extends generally upwardly and inwardly toward the central axis 10 (e.g., assuming a generally frustumly-shaped configuration). Both the transition section 28 and skirt 30 are concentrically positioned about the central axis 10 of the container 2.

A column-like or neck-like crown 34 extends upwardly from a plane containing the seam 26 a sufficient distance to allow for effective drinking from the crown 34 upon an opening of the container 2. The crown 34 includes a crown sidewall 38. A first section 80 of the crown sidewall 38 converges toward the central axis 10 (i.e., tapers inwardly), while a second section 82 diverges from the central axis 10 (i.e., tapers outwardly). The crown 34 further includes a top 76 which has an annular, substantially horizontally disposed perimeter section 78 and a recessed opening panel 48 (i.e., positioned at a lower elevation than the perimeter section 78) which is the openable structure which will be discussed in more detail below. The crown 34 is also centered relative to the central axis 10 and the radially outermost annular portion thereof defines a crown diameter 42.

As noted above, the crown 34 functions to provide for effective dispensing of the contents of the container 2. Referring to FIGS. 2–3, the top 76 of the crown 34 again includes the perimeter section 78 and this section 78 defines a recess 44. An annular triple fold 70 extends about the perimeter of the recess 44 in a lower portion thereof (i.e., the triple fold 70 is disposed below the uppermost surface of the top 76 of the crown 34). Generally, the triple fold 70 is formed by folding portions of the top 76 over onto itself in the illustrated configuration.

The top 76 also includes an openable structure, namely an opening panel (e.g., a flap) 48, which includes a substantially planar base panel 66 and one embodiment of an engagement section 50 which is offset relative to the center of the opening panel 48 which in the illustrated embodiment coincides with the central axis 10, although the crown 34 and thus the opening panel 48 could be offset relative to the central axis 10 of the container 2 (not shown). A transition section 62 extends between the engagement section 50 and the triple fold 70. An annular perimeter of the opening panel 48 is positioned under the upper part of the triple fold 70 and thus is part of the triple fold 70. Consequently, when the opening panel 48 is opened in the manner discussed below, the remaining upper orifice does not include any sharp edges (e.g., the doubling over of the sheet metal to define the triple fold 70 provides a rounded surface for engagement by the lips of the beverage consumer even after the container 2 is opened). Although different segments are referred to with regard to the end piece 100, it will be appreciated that in the illustrated embodiment it is integrally formed (i.e., of continuous construction and made from a single piece of sheet metal).

The engagement section 50 is configured to allow for effective opening of the opening panel 48 and is disposed on the "public side" of the end piece 100 or that side of the end piece 100 which defines the exterior of the container 2. Initially, in one embodiment, the engagement section 50 has its perimeter defined by a first arc 54 and a second arc 58. Moreover, the engagement section 50 curves upwardly from the first arc 54, which is positioned closer to the center of the opening panel 48, toward the second arc 58. The second arc 58 thereby defines a ridge which is arcuately disposed about the opening panel's 48 central axis (although not necessarily at a continuous radius). Consequently, the engagement section 50 may be characterized as a substantially concave, arcuate surface. Moreover, the engagement section 50 may be further characterized as being an upwardly ramped surface from an interior portion of the opening panel 48 to a more perimeter portion thereof. Furthermore, the engagement section 50 may be further characterized as generally approximating the contour of a human beverage consumer's thumb and thus providing a comfortable surface for interacting with the beverage consumer.

Although the engagement section 50 may be of varying dimensions, in one embodiment, the first arc 54 and the second arc 58 each are a radius of 0.340". Moreover, the curvature between the first arc 54 and the second arc 58 (i.e., the degree of concavity) is a radius of about 0.750". Furthermore, the engagement section 50 extends a vertical distance of about 0.050" above the base panel 66, in comparison to the uppermost surface of the top 76 which extends a vertical distance of about 0.100" above the base panel 66.

In addition to providing a comfortable surface for engagement by a beverage consumer, the engagement section 50 and further characteristics of the opening panel 48 interact to provide an easy-to-open opening panel 48. Initially, a portion of the perimeter on the opening panel 48 is defined by a score 111 which is disposed on the "product side" of the end piece 100. The score 111 extends through a portion of the thickness of the end piece 100 and leaves a fracturable web 110 of reduced thickness in comparison with the thickness of the end piece 100 to reduce the amount of forces required to open the opening panel 48. Other features of the score 111 will the discussed in more detail below. A remainder of the perimeter of the opening panel 48 is defined by a hinged connection 86 (e.g., having an arc length of about 0.187"). As such, the opening panel 48 may be depressed within the interior of the container 2 to affect an opening thereof and yet still remain attached to the end piece 100. In one embodiment, the "resistance" of the fracturable web 110 to fracture decreases along the perimeter as the distance from the hinged connection 86 increases. For instance, the thickness of the fracturable web 110 may decrease as the distance from the hinged connection 86 increases along the perimeter of the opening panel 48. Consequently, the structurally weakest part of the fracturable web 110 is disposed substantially opposite the hinged connection 86. A more complete description of the bottom 28, as well as the end piece 100, may be found in commonly assigned U.S. patent application Ser. No. 08/304,676 entitled "Improved End Construction for Drawn and Ironed Containers," filed on Sep. 12, 1994, which is incorporated herein by reference in its entirety.

In order to effectively seal the container 2 to substantially inhibit leakage of the contents therein and/or to substantially inhibit corrosion of the metal on the product side of the end piece 100, post repair material 150 is applied into the score 111. For purposes of facilitating application of the post repair material 150 and the flow of the post repair material 150 into the score 111, the post repair material 150 may be both a meltable material, one which adheres to metal surfaces, and one which has a liquid viscosity ranging from about 500 centipoise to about 50,000 centipoise at an appropriate deposition temperature. Additionally, to avoid adversely altering the taste of the product within the container 2, the post repair material 150 is preferably tasteless and/or odorless. The post repair material 150 may be selected from the group consisting of flowable waxes (e.g., paraffin) and thermoplastic polymeric sealants, such as "Hot Melt™" (available from National Starch & Chemical Company), plastisol, and powder coatings.

Figure 4:
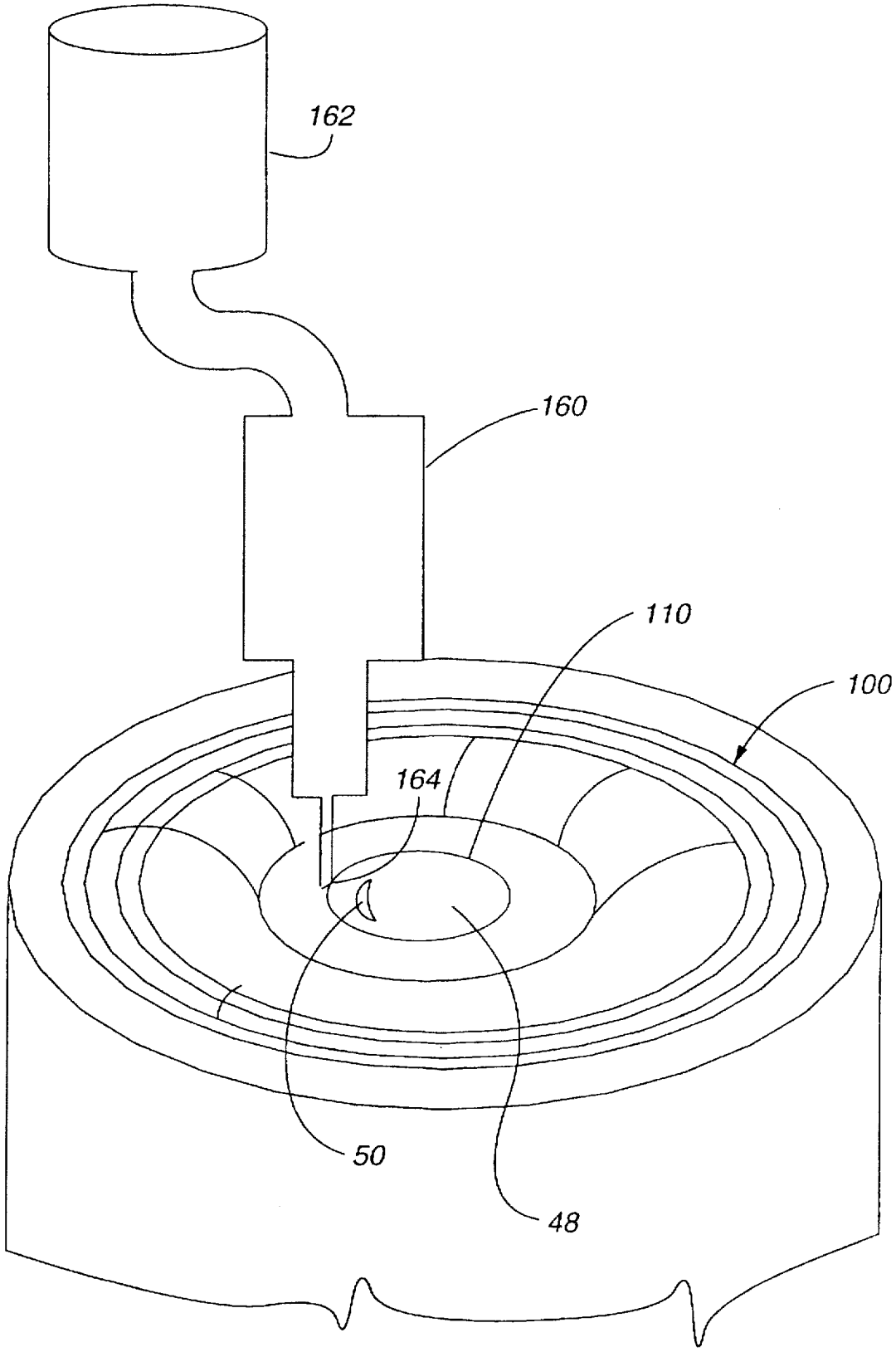
FIG. 4 is a perspective view of an apparatus for applying post repair material to an end piece according to principles of the present invention.

The post repair material 150 may be deposited in the score 111 using the applicator 160 illustrated in FIG. 4. In order to prepare the post repair material 150 for application into the score 111, the post repair material 150 may be heated to a temperature sufficient to bring the post repair material 150 to effectively a liquid state (e.g., generally near or above the melting temperature of the post repair material 150). Heating the post repair material 150 provides for a liquid post repair material 150, such as a thermoplastic polymeric sealant, capable of flowing into the score 111 to fill the score 111 to a desired level. In one embodiment, the post repair material 150 is heated prior to entering the score 111 by heating the post repair material 150 in a reservoir 162 which is operatively associated with the applicator 160. In this regard, where the post repair material 150 comprises Hot Melt™, the post repair material 150 may be heated prior to entering and/or within the applicator 160 (which will be described hereinbelow) prior to application to the score 111. For purposes of increasing efficiency in the application of post repair material 150 into the score 111, the post repair material 150 may be preheated in the reservoir 162 to a temperature generally near or above the melting point of the post repair material 150. Where the post repair material 150 comprises "Hot Melt™", the post repair material 150 may be heated to a temperature of between about 35° C. and about 260° C. to melt the post repair material 150 to a liquid state wherein the liquid post repair material 150 is capable of flowing into the score 111 to seal the score 111, and therefore the end piece 100.

Once heated to a liquid state, the post repair material 150 may be applied to the score 111 to effectively seal the score 111. In this regard, the post repair material 150 should be applied such that it is received and retained within a substantial portion of the score 111. The post repair material 150 may be applied into the score 111 by depositing a stream of post repair material 150 into the score 111 such that it is received and retained within the score 111. This may be accomplished by inverting the end piece 100, substantially as shown in FIG. 4, such that the score 111 is capable of containing post repair material 150. In one embodiment, for purposes of facilitating "filling" the interior of the score 111 with post repair material 150 such that it may be quickly and efficiently applied (e.g., dropped or injected) into the score 111, the post repair material 150 may be regulated (i.e., controlled). For example, where the applicator 160 is used to apply the post repair material 150 into the score 111, the post repair material 150 may be pressurized and the flow of post repair material 150 exiting the applicator 160 may be regulated to provide a generally steady and controllable stream of post repair material 150 exiting the nozzle 164 of the applicator 160. In this regard, the volume and/or velocity of post repair material 150 exiting the nozzle 164 of the applicator 160 for discrete and selected time periods may be controlled. In such instances, the post repair material 150 within the applicator 160 and/or the reservoir 162 may be pressurized to a pressure ranging from about 10 psi to about 3000 psi. In addition, the volume and/or velocity of the deposition of the post repair material 150 may be controlled by an appropriate control system (not shown).

For purposes of increasing the efficiency of sealing end pieces 100 such that a number of end pieces 100 may be sealed quickly and effectively, the end piece 100 is rotated relative to the applicator 160. More specifically, and in view of the generally annular configuration of the score 111 (i.e., the score 111 is of a substantially constant radius), in order to apply post repair material 150 into the score 111 of the end piece 100, the end piece 100 may be rotated and/or revolved relative to the applicator 160. In one embodiment, the end piece 100 may be rotated or spun about vertical axis 10 through at least 180 degrees as post repair material 150 is injected into the score 111 by a single stationary applicator 160. In this regard, post repair material 150 may be applied into the score 111 from a single, stationary location above the score 111 as the end piece 100 is rotated through at least 180 degrees relative to and below the applicator 160, the vertical axis 10 of the end piece 100 being offset from the single stationary applicator 160 by a length generally corresponding to a radius of the opening panel 48. In order to apply post repair material 150 into the score 111 from a single, stationary source (e.g., applicator 160) while accommodating the hinged connection 86, which does not require an application of post repair material 150, the end piece 100 may be rotated about the vertical axis 10 through at least about 270 degrees. In one embodiment, the end piece 100 is rotated about the vertical axis 10 through at least about 340 degrees.

The rate of rotation of the end piece 100 is dependent upon the amount of post repair material 150 to be applied into the score 111 and the amount of post repair material 150 that can be delivered to the score 111 from the single stationary applicator 160 for a selected rotation of the end piece 100. For example, where the post repair material 150 is "Hot Melt" which is delivered from the applicator 160 at about 1 mg/ms, and the score 111 is to be substantially filled with post repair material 150, the rate of rotation of the end piece 100 is about 1200 rpm. In other instances, where the post repair material 150 is "Hot Melt", the rate of rotation of the endpiece 100 can vary between about 500 rpm and about 3000 rpm, depending upon the amount of "Hot Melt" being delivered from the applicator 160 over time.

In an alternative but not preferred embodiment, an applicator may be positioned above the score 111 of the end piece 100 and moved in a generally circular path which substantially corresponds to the configuration of the score 111. In this regard, the applicator may revolve about the end piece 100, and specifically, along the perimeter of the opening panel 48 above the score 111, while applying post repair material into the score 111.

The lower surface 66 of the end piece 100 may also be coated to generally inhibit corrosion of the lower surface 66, especially since the lower surface 66 of the end piece 100 comes into periodic contact with the product within the container 2. In one embodiment, the coating step may be conducted in conjunction with the step of applying post repair material 150 into the score 111. In this regard, a coating system may spray a layer of coating material onto the lower surface 66 of the end piece 100 before, during or after post repair material 150 is applied into the score 111. For example, for purposes of quickly and efficiently sealing and coating a number of end pieces 100, the step of applying post repair material 150 is timed to coincide with the step of pulsed spraying of the coating material. The coating material is preferably sprayable and may be selected from the group consisting of powdered plastic resins, plastisols and hot melts.

As noted above, in the preferred embodiment the post repair material 150 is applied into the score 111 as the end piece 100 is rotated about its vertical axis 10 such that a stationary applicator 160 may be utilized. In order to allow for sufficient post repair material 150 to be ultimately retained within the major portion of the score 111 (e.g., by counteracting the centrifugal force generated by the rotational movement of the end piece 100 and the effect on the post repair material 150 during this motion; by providing an area into which post repair material 150 may flow during rotation of the end piece 100 and which will allow post repair material 150 to flow back into the major portion of the score 111 after rotation of the end piece 100 is terminated), the score 111 may include an appropriately configured reservoir.

Figure 5:
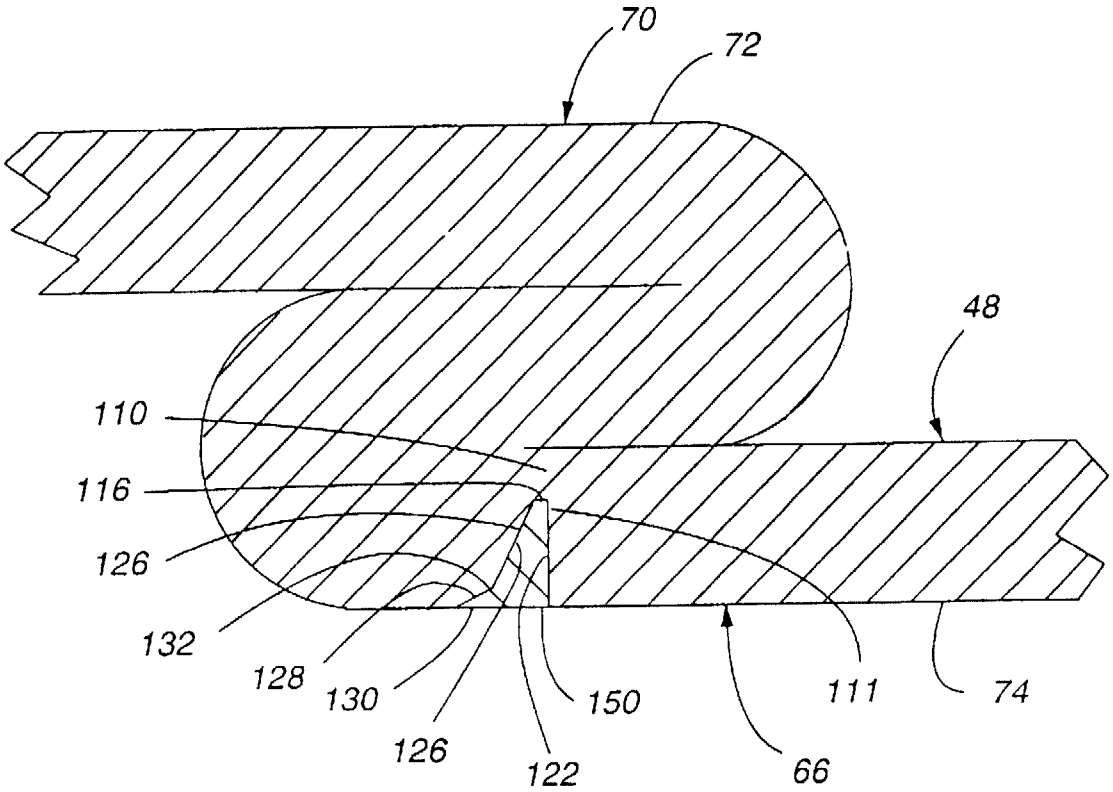
FIG. 5 is an enlarged cross-sectional view of one embodiment of a score for the opening panel of FIG. 3.
Figure 5A:
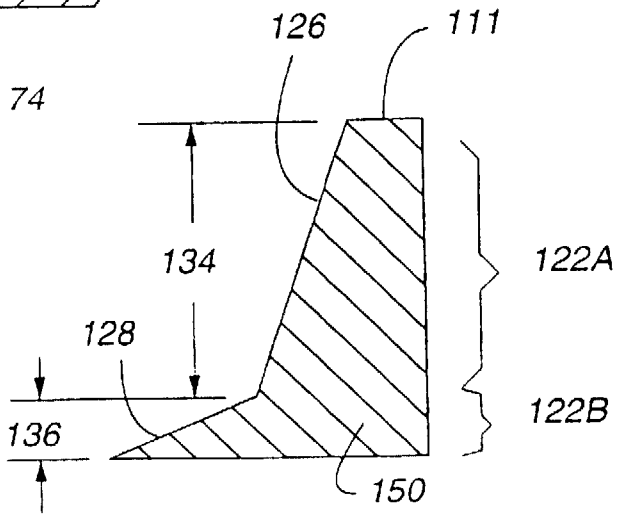
FIG. 5A is an enlarged view of the score of FIG. 5.

One embodiment of a score configuration which includes the above-noted type of reservoir is illustrated in FIGS. 5 and 5A. The score 111 is defined by an end wall 116, a first inner wall 122, a first outer wall 126, and a second outer wall 128. A first score section 134 is defined by the first inner wall 122A, the end wall 116, and the first outer wall 126, while a second score section 136 is defined by the first inner wall 122B and the second outer wall 128. The second score section 136 is disposed between the first score section 134 and the bottom 66 of the end piece 100.

Generally, the end wall 116 is disposed substantially parallel with the major portion of the lower surface 66 of the end piece 100, whereas the first inner wall 122 is disposed generally perpendicularly with this lower surface 66. The first outer wall 126 is disposed at an angle relative to the first inner wall 122, while the second outer wall 128 is disposed at an angle relative to the first inner wall 126. That is, the first outer wall 126 and the second outer wall 128 are disposed at generally different slopes such that there is a discontinuity 132 therebetween. The portion of the score 111 disposed outwardly of the projection of the first outer wall 126 defines an outer reservoir 130. That is, if the first outer wall 126 would be extended to intersect the bottom surface 66 of the end piece 100, the portion of the score 111 disposed radially outwardly of this projection is the outer reservoir 130.

In one embodiment, the score 111 has the following characteristics: 1) the width of the end wall 116 ranges from about 0.0005 inches to about 0.0025 inches; 2) the first inner wall 122 is generally perpendicular to this end wall 116 and has a length ranging from about 0.006 inches to about 0.010 inches; 3) the first outer wall 126 is generally linearly extending and has a length ranging from about 0.005 inches to about 0.009 inches; 4) the first outer wall 126 is disposed at an angle relative to the first inner wall 122 ranging from about 10° to about 30°; 5) the second outer wall 128 is generally linearly extending and has a length ranging from about 0.003 inches to about 0.008 inches; 6) the second outer wall 128 is disposed at an angle relative to the first outer wall 126 ranging from about 40° to about 80°; 7) the depth of the score 111, as measured from the end wall 116 to the lower surface 66, ranges from about 0.006 inches to about 0.010 inches; 8) the depth of the reservoir 130, as measured from the lower surface 66 to the discontinuity 132, disposed between the first outer wall 126 and the second outer wall 128, ranges from about 0.002 inches to about 0.005 inches; and 9) the ratio of the depth of the score 111 to the depth of the reservoir 130 ranges from about 9 to 1 to about 9 to 4.

In a variation of the score 111 of FIG. 5, the second outer wall 128 is defined by a radius such that the second outer wall 128 is concave relative to the interior of the score 111. In one embodiment, this radius ranges from about 0.010 inches to about 0.040 inches, and in another embodiment this radius is at least 0.005. The arc length of the reservoir 130, as measured from the lower surface 66 to the discontinuity 132, ranges from about 0.001 inches to about 0.007 inches.

The above-described reservoir 130 may be characterized as extending radially outwardly from the first outer wall 126 and relative to the end wall 116. The reservoir 130 preferably extends radially outwardly from the first outer wall 126 such that it is able to receive post repair material 150 which is forced radially outwardly as the end piece 100 is rotated while post repair material 150 is being deposited in the score 111 and/or such that it provides resistance to radially outward movement of the post repair material 150 as the end piece 100 is rotated while post repair material 150 is being deposited in the score 111. As post repair material 150 is applied within the score 111 such that it is received between the first inner wall 122 and the first outer wall 126 of the score 111, the post repair material 150 may be captured or retained within the score 111 as the end piece 100 is rotated due to the configuration of the reservoir 130. More specifically, the post repair material 150 is retained within the score 111 as the reservoir 130 provides a receiving area for the post repair material 150 which otherwise may have been slung out of the score 111 during application of the post repair material 150. In this regard, once the post repair material 150 has been annularly applied into the score 111 and rotation of the end piece 100 has terminated, settling of the liquid post repair material 150 in the reservoir 111, and particularly, within that portion of the score 111 defined by the end wall 116 and between the first inner wall 122A and the first outer wall 126, may occur as post repair material 150 forced into the reservoir 130 during rotation of the end piece 100 flows back into this area.

In one embodiment of the invention, the post repair material 150 is applied into the interior of the score 111 such that a layer of post repair material 150 is positioned between the end wall 116 of the score 111 and the product within the container 2. Additionally, the post repair material 150 should extend between the first inner wall 122 and the first outer wall 126 of the score 111 to provide an effective seal of the score 111. In this regard, the post repair material 150 substantially inhibits corrosion of the score 111, including the end wall 116 of the score 111, by providing a barrier between the score 111 and the product within the container 2. In a preferred embodiment, the post repair material 150 seals the end wall 116 of the score 111 from the product within the container 2 and occupies between about 70% and about 100% of the vertical extent of the score 111.

Figure 6:
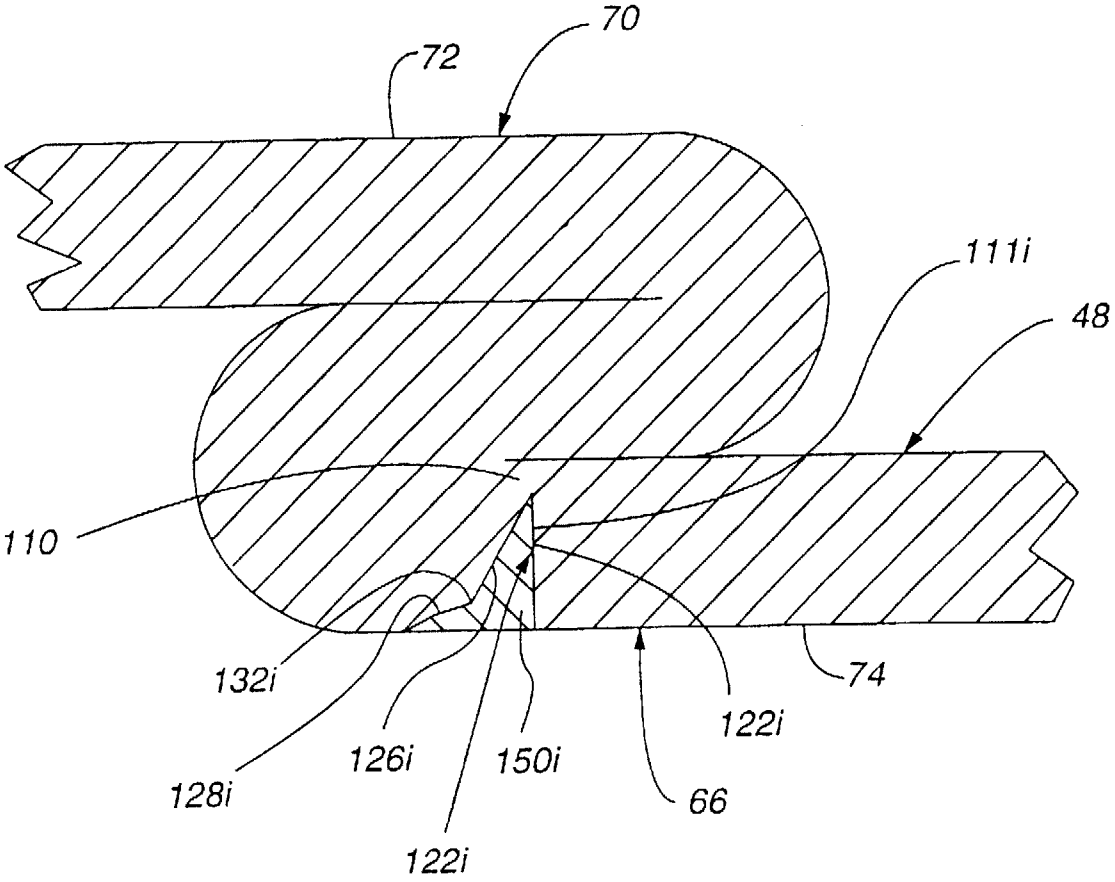
FIG. 6 is an enlarged cross-sectional view of another embodiment of a score for the opening panel of FIG. 3.

An embodiment having the same general configuration of the score 111 of FIG. 5 is illustrated in FIG. 6. The score 111$^{i}$ differs from the score 111 primarily in relation to the dimensions/relative orientations of the various parts of the score 111$^{i}$ and therefore the general description provided regarding the score 111 is equally applicable to this embodiment. In one embodiment, the score 111$^{i}$ has the following characteristics: 1) the end wall 116$^{i}$ is generally a point; 2) the first inner wall 122$^{i}$ is generally perpendicular to the bottom surface 66 or parallel with the axis 10 and has a length ranging from about 0.006 inches to about 0.010 inches; 3) the first outer wall 126$^{i}$ is generally linearly extending and has a length ranging from about 0.005 inches to about 0.009 inches; 4) the first outer wall 126$^{i}$ is disposed at an angle relative to the first inner wall 122$^{i}$ ranging from about 10° to about 30°; 5) the second outer wall 128$^{i}$ is generally linearly extending and has a length ranging from about 0.003 inches to about 0.008 inches; 6) the second outer wall 128$^{i}$ is disposed at an angle relative to the first outer wall 126$^{i}$ ranging from about 40° to about 80°; 7) the depth of the score 111$^{i}$, as measured from the point 116$^{i}$ to the lower surface 66, ranges from about 0.006 inches to about 0.010 inches; 8) the depth of the reservoir 130$^{i}$, as measured from the lower surface 66 to the discontinuity 132$^{i}$, disposed between the first outer wall 126$^{i}$ and the second outer wall 128$^{i}$, ranges from about 0.002 inches to about 0.005 inches; and 9) the ratio of the depth of the score 111$^{i}$ to the depth of the reservoir 130$^{i}$ ranges from about 9 to 1 to about 9 to 4.

In a variation of the score 111$^{i}$ of FIG. 6, the second outer wall 128$^{i}$ is defined by a radius such that the second outer wall 128$^{i}$ is concave relative to the interior of the score 111$^{i}$. In one embodiment, this radius ranges from about 0.010 inches to about 0.040 inches, and in another embodiment is at least 0.005 inches. The arc length of the reservoir 130$^{i}$, as measured from the lower surface 66 to the discontinuity 132$^{i}$, ranges from about 0.001 inches to about 0.007 inches.

Figure 7:
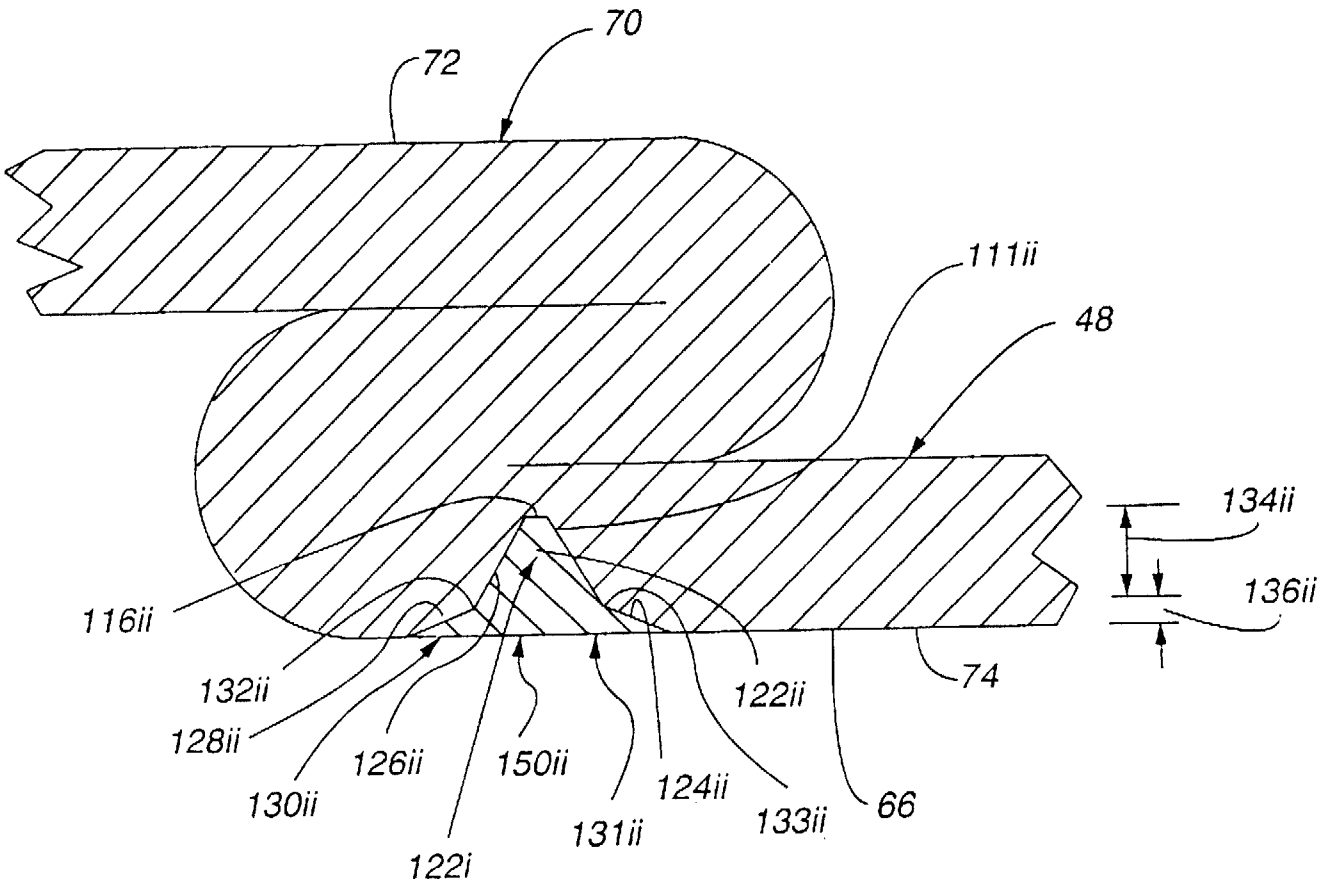
FIG. 7 is an enlarged cross-sectional view of another embodiment of a score for the opening panel of FIG. 3.

Another embodiment of a score configuration which includes the above-noted type of reservoir is illustrated in FIG. 7. The score 111$^{ii}$ is defined by an end wall 116$^{ii}$, a first inner wall 122$^{ii}$, a first outer wall 126$^{ii}$, a second inner wall 124$^{ii}$, and a second outer wall 128$^{ii}$. A first score section 134$^{ii}$ is defined by the first inner wall 122$^{ii}$, the end wall 116$^{ii}$, and the first outer wall 126$^{ii}$, while a second score section 136$^{ii}$ is defined by the second inner wall 124$^{ii}$ and the second outer wall 128$^{ii}$. The second score section 136$^{ii}$ is disposed between the first score section 134$^{ii}$ and the bottom 66 of the end piece 100.

Generally, the end wall 116$^{ii}$ is disposed substantially parallel with the lower surface 66 of the end piece 100 or perpendicular to the axis 10. The first inner wall 122$^{ii}$ is disposed at an angle relative to the end wall 116$^{ii}$ and the first outer wall 126$^{ii}$ is symmetrically disposed. The second inner wall 124$^{ii}$ is disposed at an angle relative to the first inner wall 122$^{ii}$ and the second outer wall 128$^{ii}$ is symmetrically disposed. That is, the first inner wall 122$^{ii}$ and the second inner wall 124$^{ii}$ are disposed at generally different slopes such that there is a discontinuity 133$^{ii}$ therebetween, while the first outer wall 126$^{ii}$ and the second outer wall 128$^{ii}$ are disposed at generally different slopes such that there is a discontinuity 132$^{ii}$ therebetween. The portion of the score 111$^{ii}$ disposed outwardly of the projection of the first outer wall 126$^{ii}$ defines an outer reservoir 130$^{ii}$, whereas the portion of the score 111$^{ii}$ disposed radially inwardly of the projection of the first inner wall 122$^{ii}$ defines an inner reservoir 131$^{ii}$. That is, if the first outer wall 126$^{ii}$ would be extended to intersect the bottom surface 66 of the end piece 100, the portion of the score 111$^{ii}$ disposed radially outwardly of this projection is the outer reservoir 130$^{ii}$. Similarly, if the first inner wall 122$^{ii}$ would be extended to intersect the bottom surface 66 of the end piece 100, the portion of the score 111$^{ii}$ disposed inwardly of this projection is the inner reservoir 131$^{ii}$.

Figure 8:
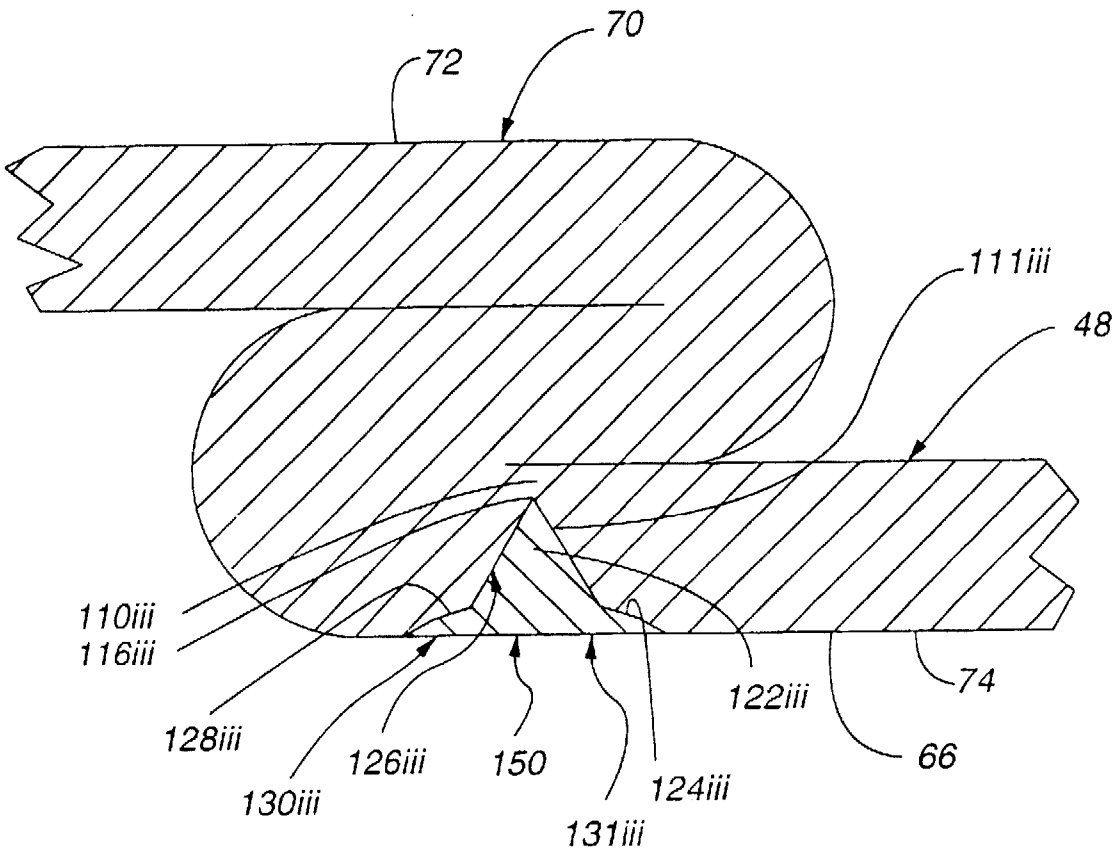
FIG. 8 is an enlarged cross-sectional view of another embodiment of a score for the opening panel of FIG. 3.

An embodiment having the same general configuration of the score 111$^{ii}$ of FIG. 7 is illustrated in FIG. 8. The score 111$^{iii}$ differs from the score 111$^{ii}$ primarily in relation to the dimensions/relative orientations of the various parts of the score 111$^{iii}$ and the general description provided regarding the score 111$^{ii}$ thereby remains equally applicable to this embodiment. In one embodiment, the score 111$^{iii}$ has the following characteristics: 1) the width of the end wall 116$^{iii}$ is generally a point; 2) the first inner wall 122$^{iii}$ is generally linearly extending and has a length ranging from about 0.006 inches to about 0.010 inches; 3) the first inner wall 122$^{iii}$ is disposed at an angle relative to a reference axis which is parallel with the axis 10 ranging from about 10° to about 30°; 4) the second inner wall 124$^{iii}$ is generally linearly extending and has a length ranging from about 0.003 inches to about 0.008 inches; 5) the second inner wall 124$^{iii}$ is disposed at an angle relative to the first inner wall 122$^{iii}$ ranging from about 40° to about 70°; 6) the first outer wall 126$^{iii}$ is symmetric relative to the first inner wall 122$^{iii}$; 7) the second outer wall 128$^{iii}$ is symmetric relative to the second inner wall 124$^{iii}$; 8) the depth of the score 111$^{iii}$, as measured from the end wall 116$^{iii}$ to the lower surface 66, ranges from about 0.006 inches to about 0.010 inches; 9) the depth of the both the inner reservoir 131$^{iii}$ and the outer reservoir 130$^{iii}$, as measured from the lower surface 66 to the discontinuity 131$^{iii}$ and the discontinuity 132$^{iii}$, respectively, ranges from about 0.006 inches to about 0.010 inches; and 10) the ratio of the depth of the score 111$^{iii}$ to the depth of the outer reservoir 130$^{iii}$/inner reservoir 131$^{iii}$ ranges from about 9 to 1 to about 9 to 4.

Figure 9:
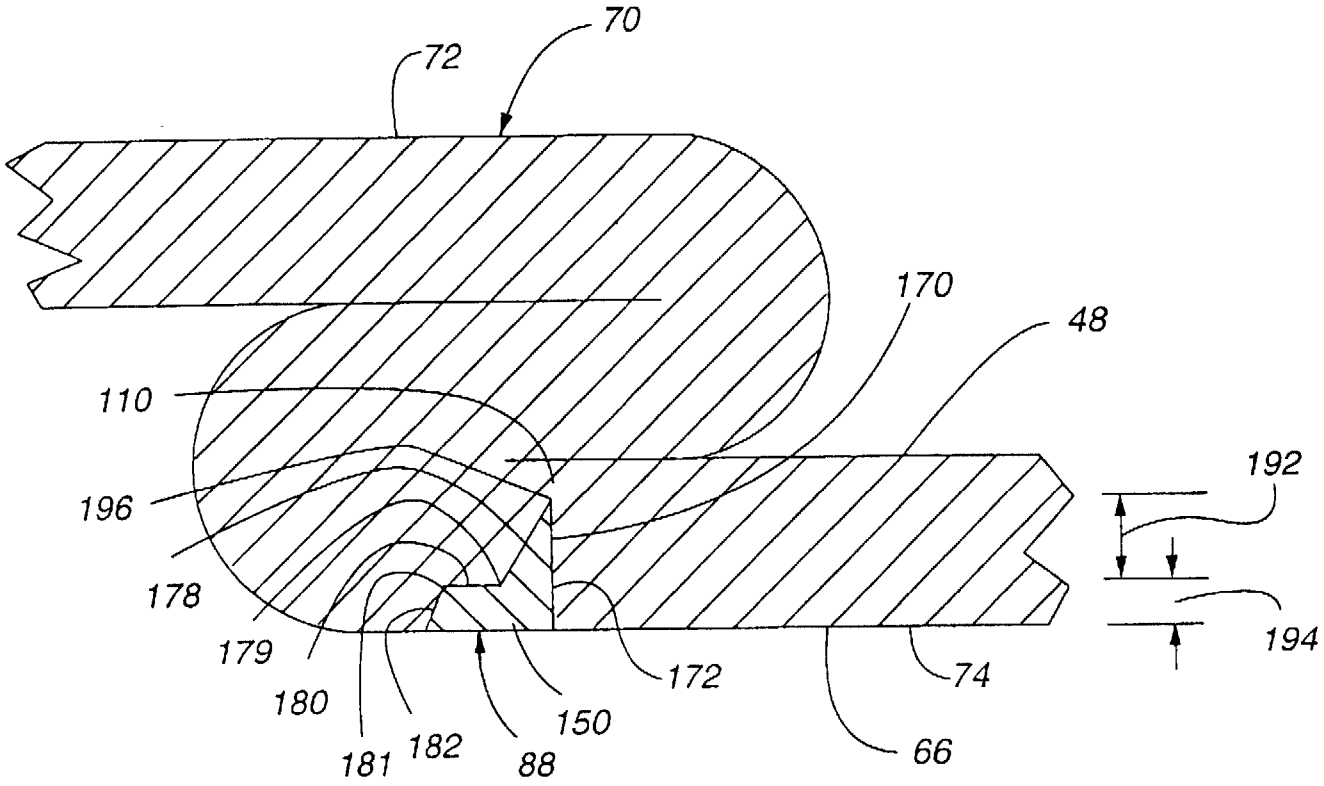
FIG. 9 is an enlarged cross-sectional view of another embodiment of a score for the opening panel of FIG. 3.

Another embodiment of a score configuration which includes the above-noted type of reservoir is illustrated in FIG. 9. The score 170 is defined by a first inner wall 172, a first outer wall 178 which intersects with the first inner wall 172 at substantially a point 196, a second outer wall 180, and a third outer wall 182. A first score section 192 is defined by a portion of the first inner wall 172 and the first outer wall 178 which intersect at the point 196, while a second score section 194 is defined by another portion of first inner wall 172, the second outer wall 180 and the third outer wall 182. The second score section 194 is disposed between the first score section 192 and the bottom 66 of the end piece 100.

The first inner wall 172 of the score 170 is disposed generally perpendicularly with the lower surface 66 or parallel with the axis 10. The first outer wall 178 is disposed at an angle relative to the first inner wall 172, the second outer wall 180 is disposed at an angle relative to the first outer wall 178, and the third outer wall 182 is disposed at an angle relative to the second outer wall 180. That is, the first outer wall 178 and the second outer wall 180 are each disposed at generally different slopes such that there is a discontinuity 179 therebetween, and the second outer wall 180 and the third outer wall 182 are each disposed at generally different slopes such that there is a discontinuity 181 therebetween. The portion of the score 170 disposed outwardly of the projection of the first outer wall 178 defines an outer reservoir 188. That is, if the first outer wall 178 would be extended to intersect the bottom surface 66 of the end piece 100, the portion of the score 170 disposed radially outwardly of this projection is the outer reservoir 188.

In one embodiment, the score 170 has the following characteristics: 1) the first inner wall 172 is generally perpendicular to the bottom 66 of the end piece 100 or parallel with the axis 10 and has a length ranging from about 0.006 inches to about 0.010 inches; 2) the first outer wall 178 is generally linearly extending and has a length ranging from about 0.005 inches to about 0.008 inches; 3) the first outer wall 178 is disposed at an angle relative to the first inner wall 172 ranging from about 10° to about 30°; 4) the second outer wall 180 is generally linearly extending and has a length ranging from about 0.004 inches to about 0.008 inches; 5) the second outer wall 180 is disposed at an angle relative to the first outer wall 178 ranging from about 60° to about 80°; 6) the third outer wall 182 is generally linearly extending and has a length ranging from about 0.002 inches to about 0.005 inches; 7) the third outer wall 182 is disposed at an angle relative to the second outer wall 180 ranging from about 10° to about 30°; 8) the depth of the score 170, as measured from the point 196 to the lower surface 66, ranges from about 0.006 inches to about 0.010 inches; 9) the depth of the outer reservoir 188, as measured from the lower surface 66 to the discontinuity 179 ranges from about 0.002 inches to about 0.005 inches; and 10) the ratio of the depth of the score 170 to the depth of the outer reservoir 188 ranges from about 9 to 1 to about 9 to 4.

Figure 10:
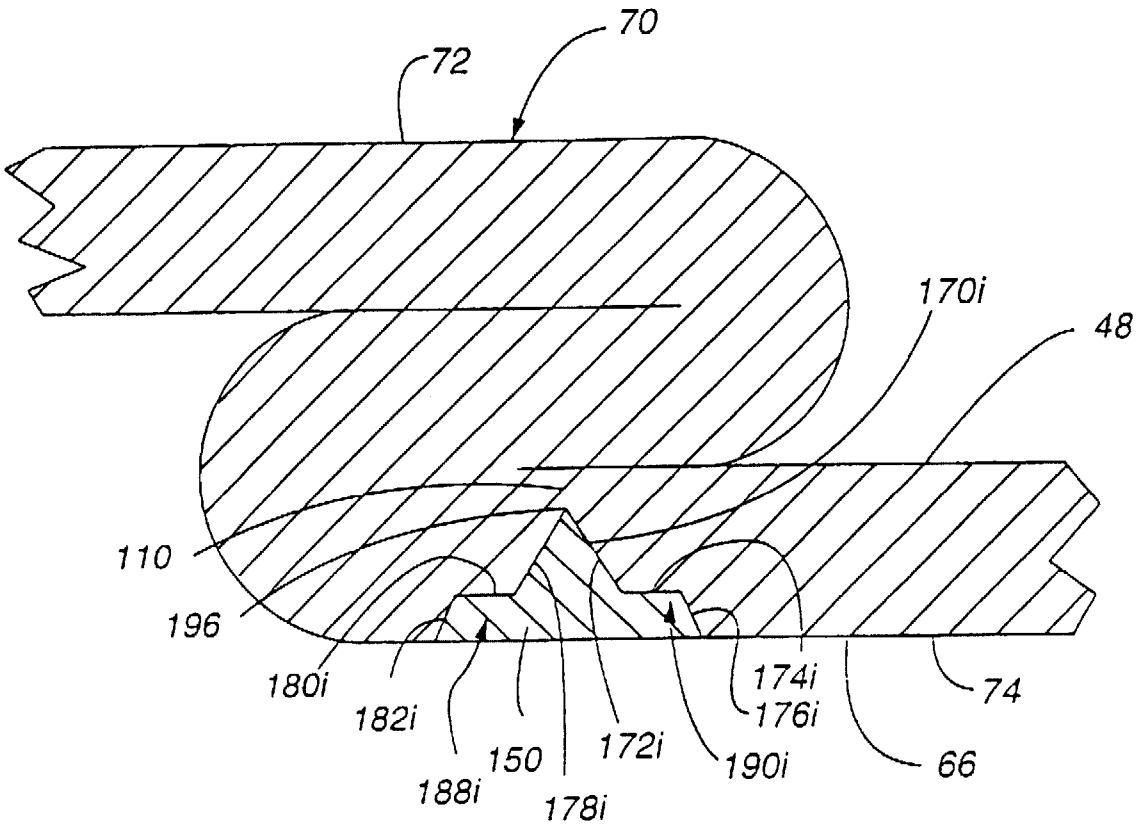
FIG. 10 is an enlarged cross-sectional view of another embodiment of a score for the opening panel of FIG. 3.

Another embodiment of a score is illustrated in FIG. 10. The score 170$^{i}$ includes a first inner wall 172$^{i}$, a second inner wall 174$^{i}$, and a third inner wall 176$^{i}$ which mirror the first outer wall 178$^{i}$, the second outer wall 180$^{i}$, and the third outer wall 182$^{i}$. The first outer wall 178$^{i}$, the second outer wall 180$^{i}$, and the third outer wall 182$^{i}$ are identical to the first outer wall 178, the second outer wall 180, and the third outer wall 182, respectively, of FIG. 9. The inner reservoir 190$^{i}$ mirrors the outer reservoir 188$^{i}$, which in turn is identical to the outer reservoir 188 of FIG. 9.

Figure 11:
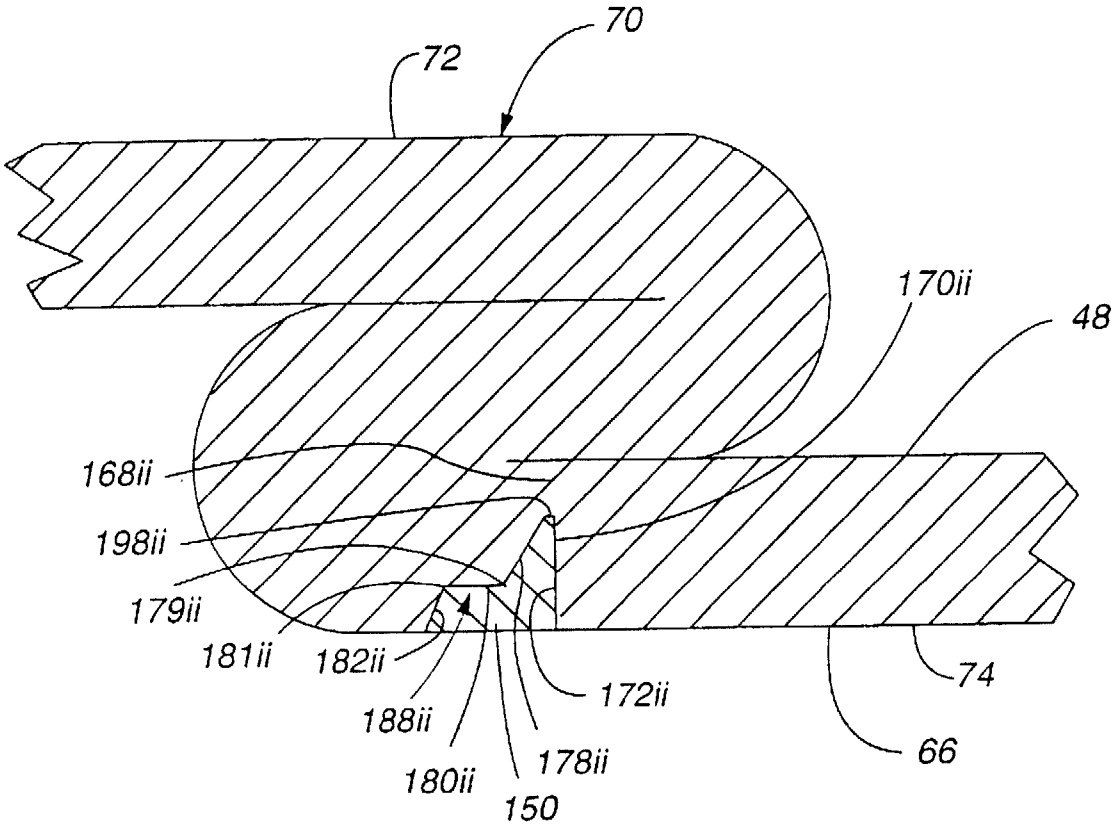
FIG. 11 is an enlarged cross-sectional view of another embodiment of a score for the opening panel of FIG. 3.

Another embodiment of a score configuration which includes the above-noted type of reservoir is illustrated in FIG. 11. The score 170$^{ii}$ is substantially similar to the score 170 of FIG. 9 except that instead of having the point 196 which defines the base of the score 170 of FIG. 9, the base of the score 170$^{ii}$ is defined by an end section 198 which is substantially parallel with the bottom surface 66 or perpendicular to the axis 10 and which in one embodiment has a width ranging from about 0.0005 inches to about 0.0025 inches.

Figure 12:
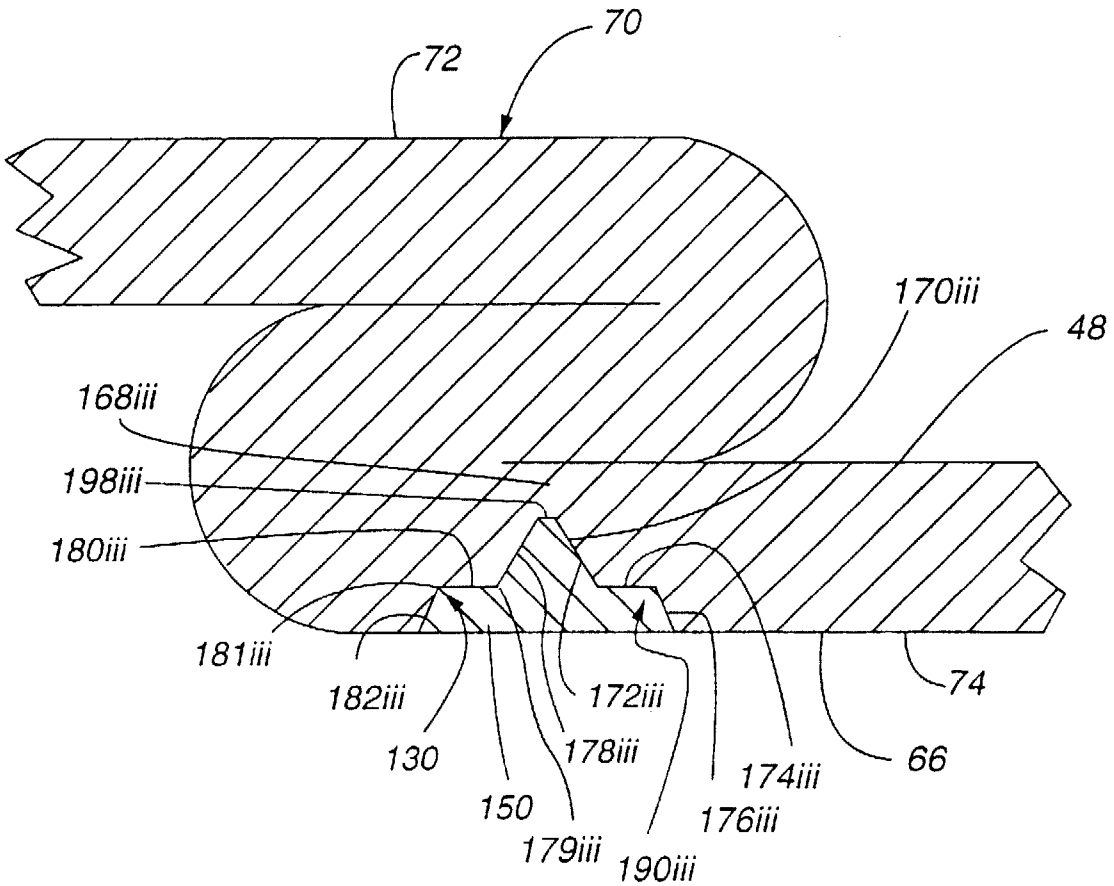
FIG. 12 is an enlarged cross-sectional view of another embodiment of a score for the opening panel of FIG. 3.

Another embodiment of a score configuration which includes the above-noted type of reservoir is illustrated in FIG. 12. The score 170$^{iii}$ is substantially similar to the score 170$^{i}$ of FIG. 10 except that instead of having the point 196$^{i}$ which defines the base of the score 170$^{i}$ of FIG. 10, the base of the score 170$^{iii}$ is defined by an end section 198$^{iii}$ which is substantially parallel with the bottom surface 66 or perpendicular to the axis 10 and which in one embodiment has a width ranging from about 0.0005 inches to about 0.0025 inches.

As illustrated in FIGS. 5–12, for purposes of facilitating the receipt and/or capture of post repair material 150 within the score 111, the score 111 may be configured in a variety of manners. In order to further reduce the forces required to open the opening panel 48 defined by the score 111, the score 111 may extend virtually entirely through the opening panel 48 as illustrated in FIGS. 3 and 5–12. Post repair material 150 may then used to fill in the score 111 and define the easy-to-open fracturable web 110. Consequently, this further reduces the forces required for fracture where the primary fracturing forces will be directed (at the engagement section 50). Moreover, due to the orientation of the engagement surface 50 in that it causes the opening forces to not only be exerted in a downward direction, but toward this weakest part of the fracturable web 110 as well, further reduction in the forces required to open the opening panel 48 are realized.

Another feature relating to the fracturable web 110 and the remaining portion of the perimeter of the opening panel 48 is that it is positioned under the upper part of the triple fold 70 and has a larger effective diameter. Therefore, in the event that the opening panel 48 breaks off at the hinged connection 86 in addition to the fracturable web 110, the potential for the opening panel 48 passing out of the container 2 is desirably reduced. Moreover and as noted above, upon opening of the opening panel 48 the upper surface of the remaining orifice is formed by a rounded edge of the remainder of the triple fold 70.

Figure 13A:
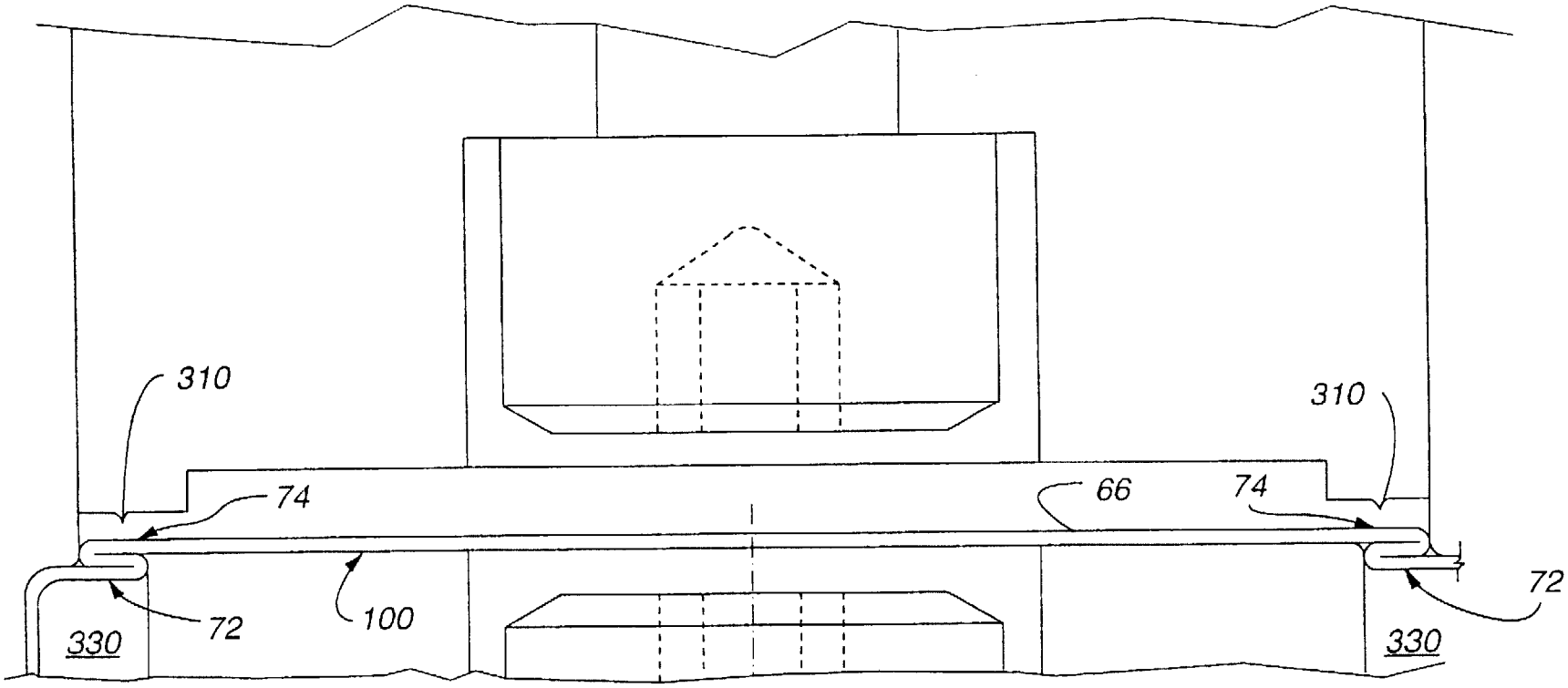
FIGS. 13A and 13B are progressive fragmentary cross-sectional views of the opening panel of the end piece prior to and during scoring, wherein scoring is accomplished by moving the scoring knife axially and relative to the end piece and the scoring anvil.
Figure 13B:
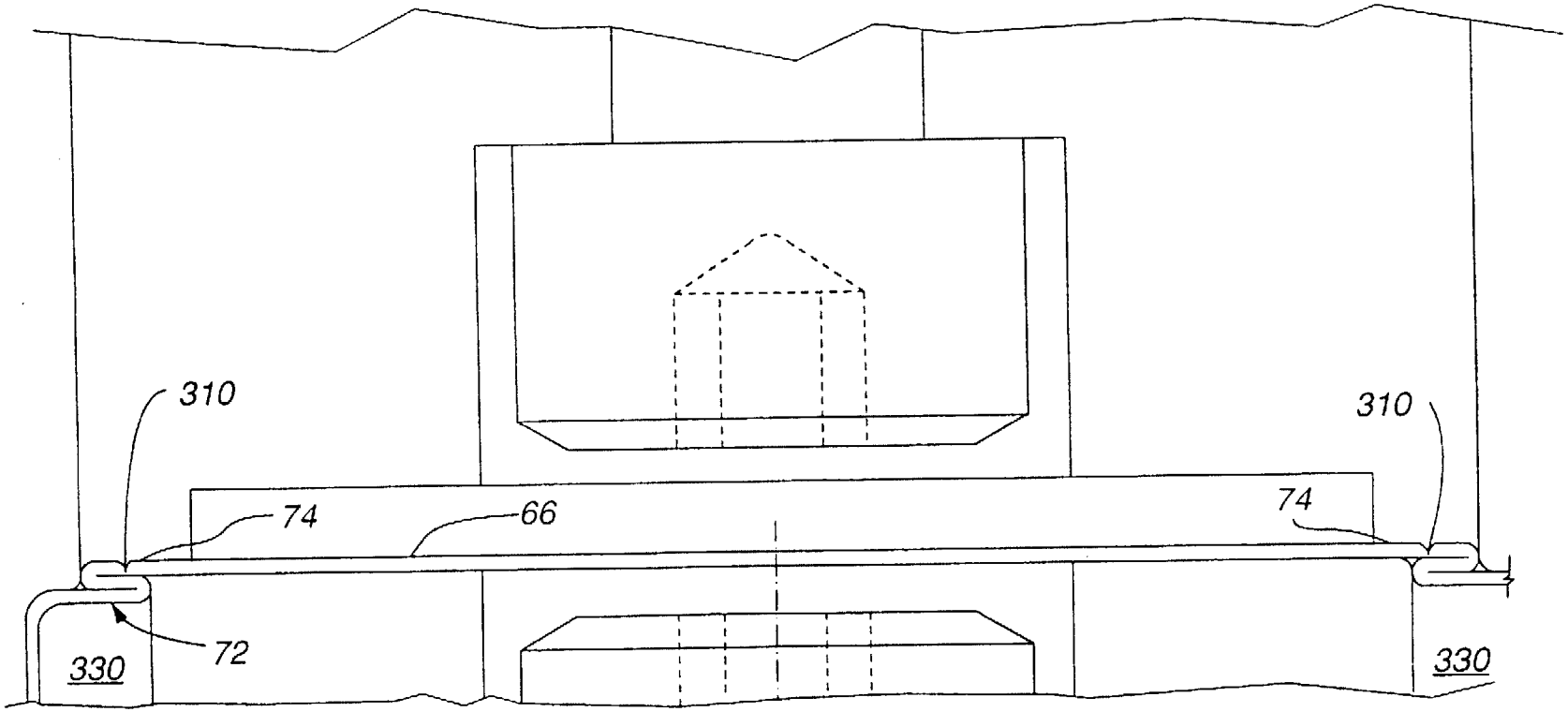
Figure 14:
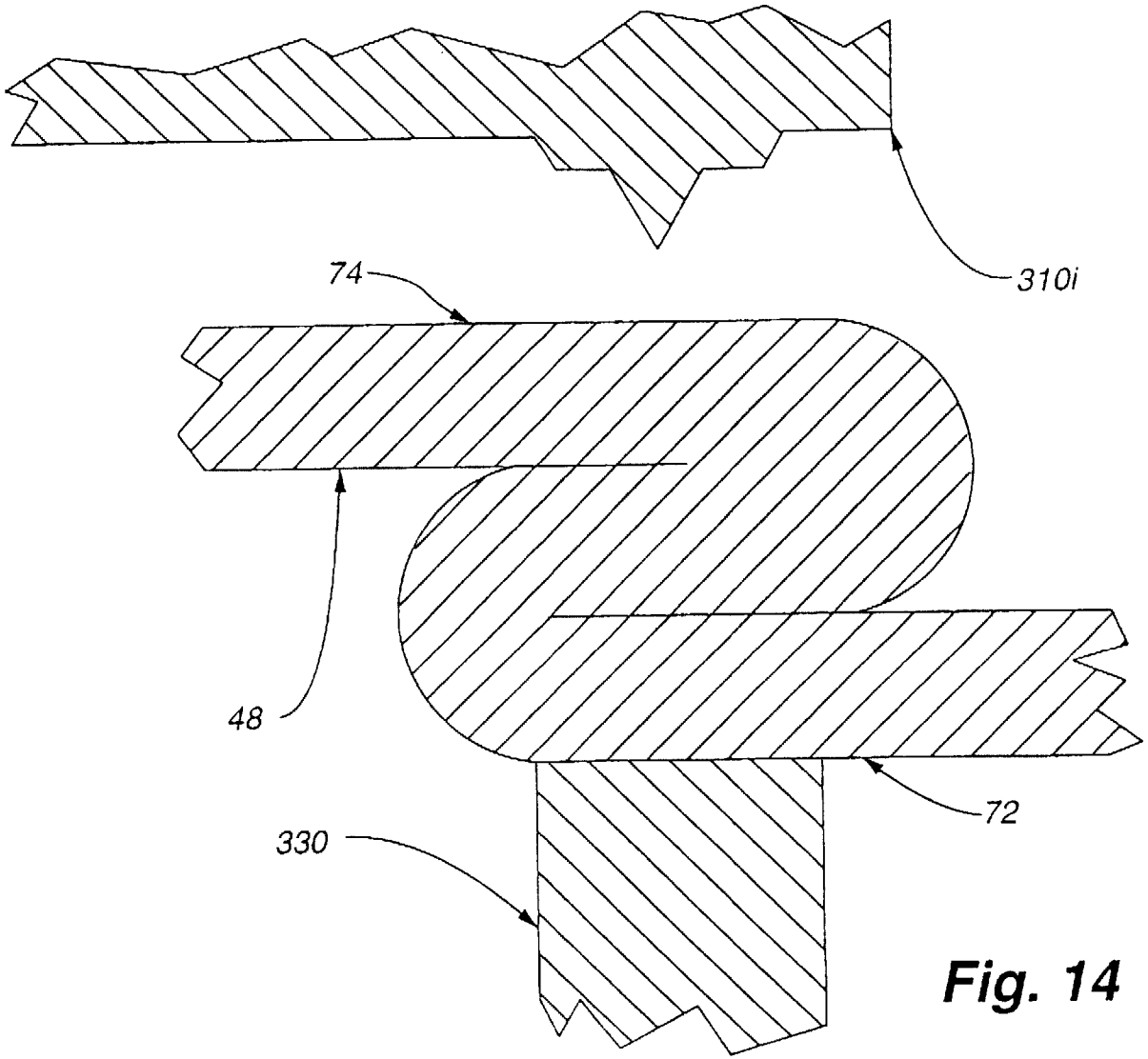
FIGS. 14–21 are enlarged cross-sectional views of various embodiments of scoring knives.
Figure 15:
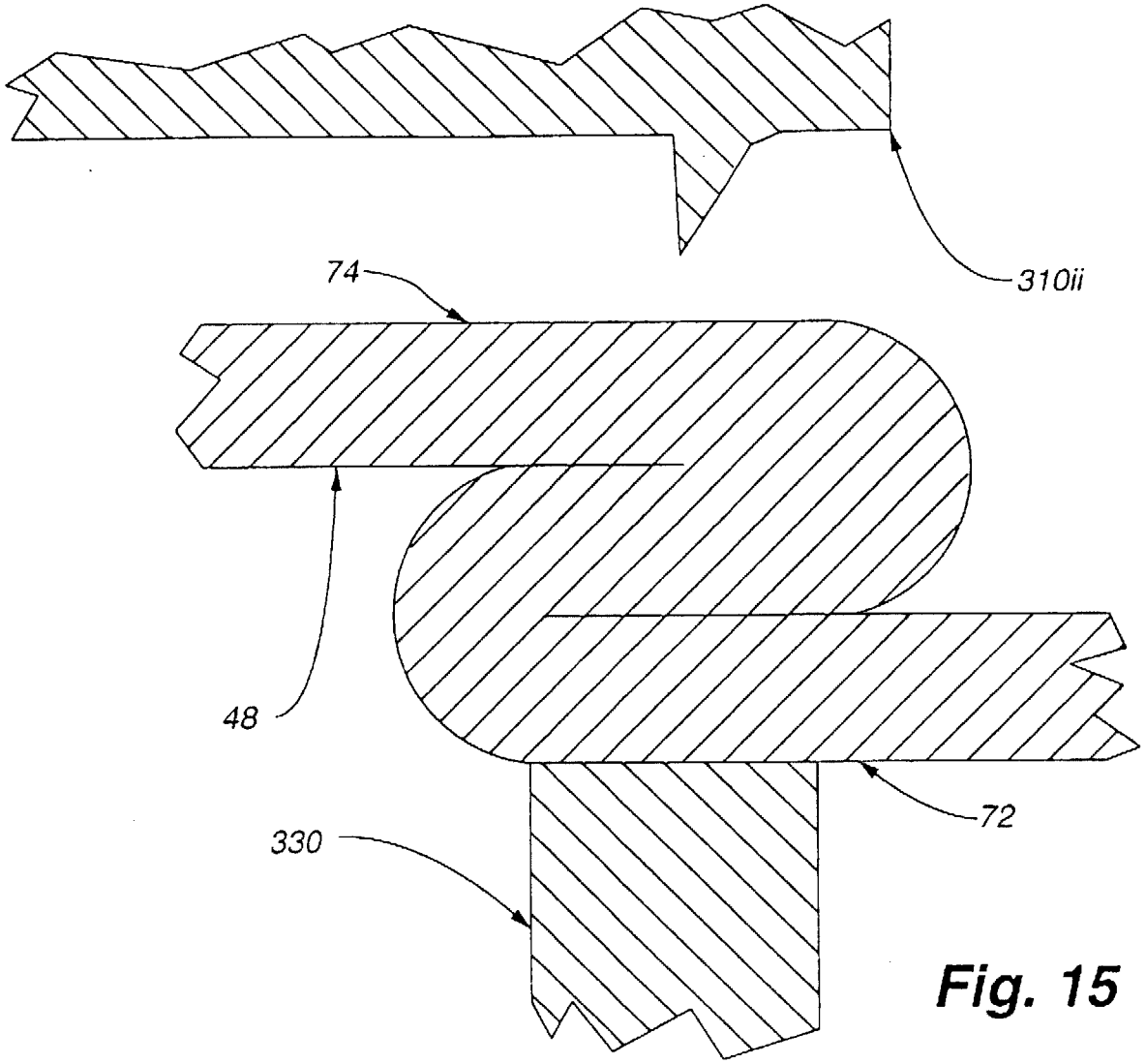
Figure 16:
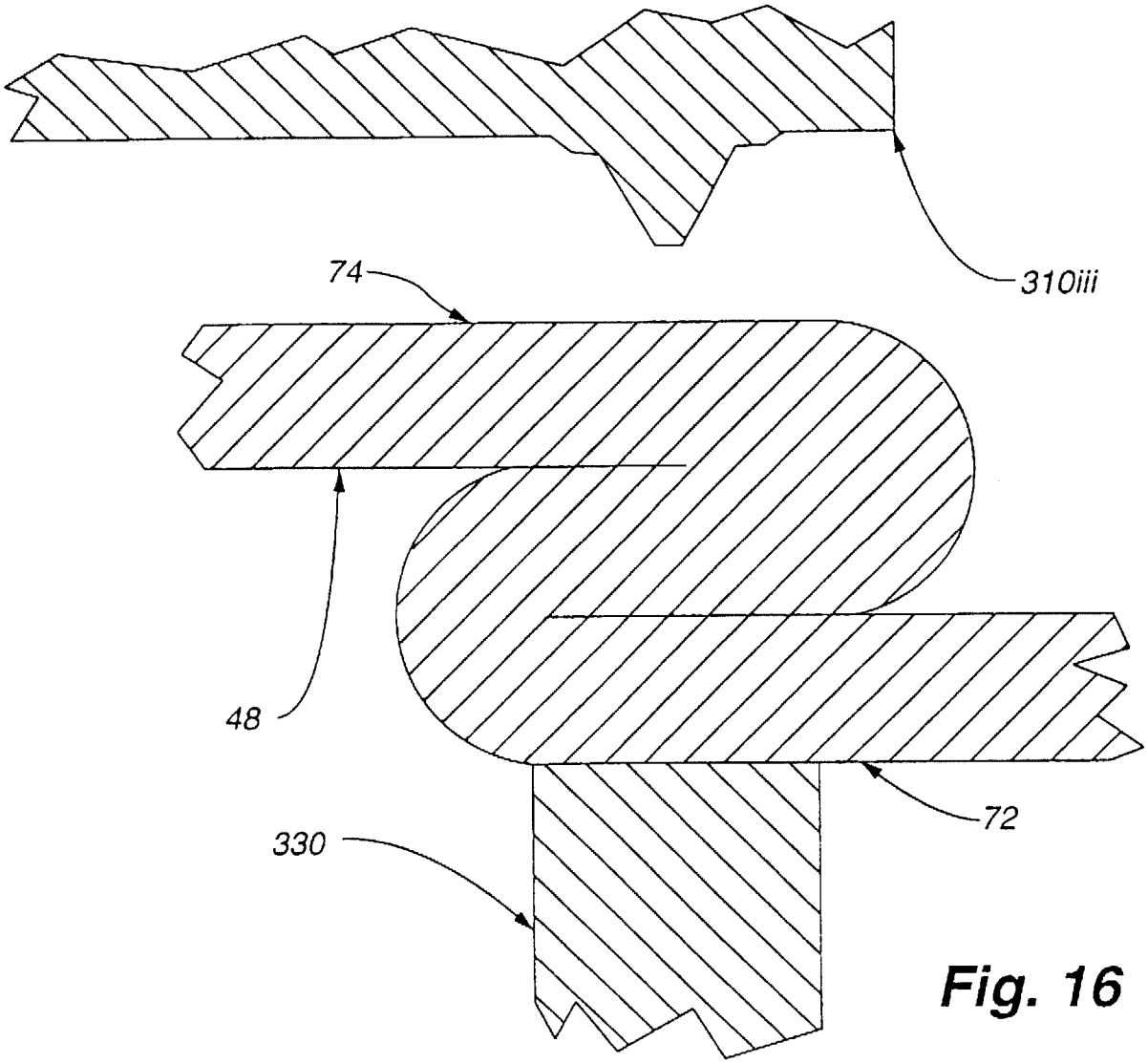
Figure 17:
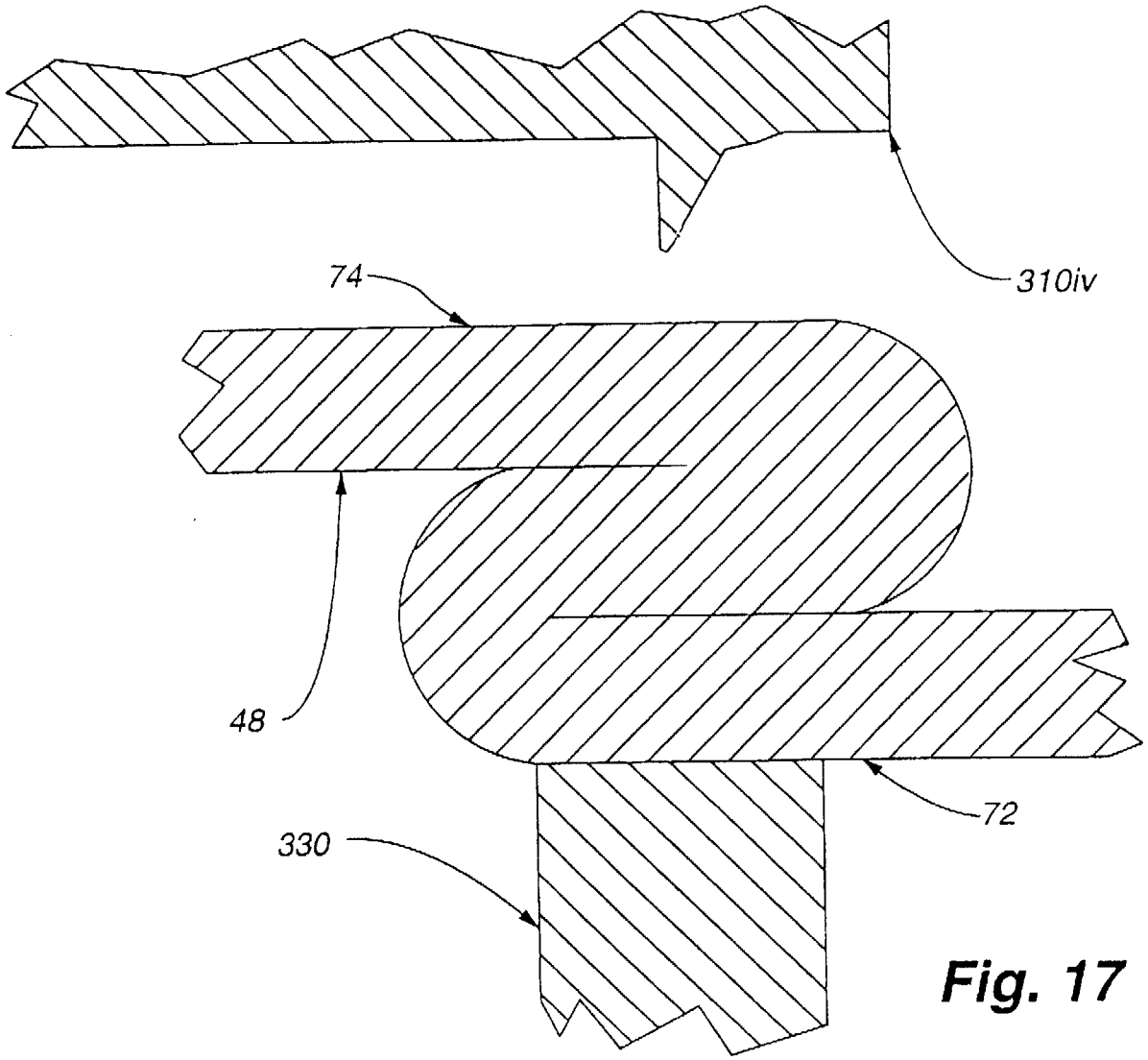
Figure 18:
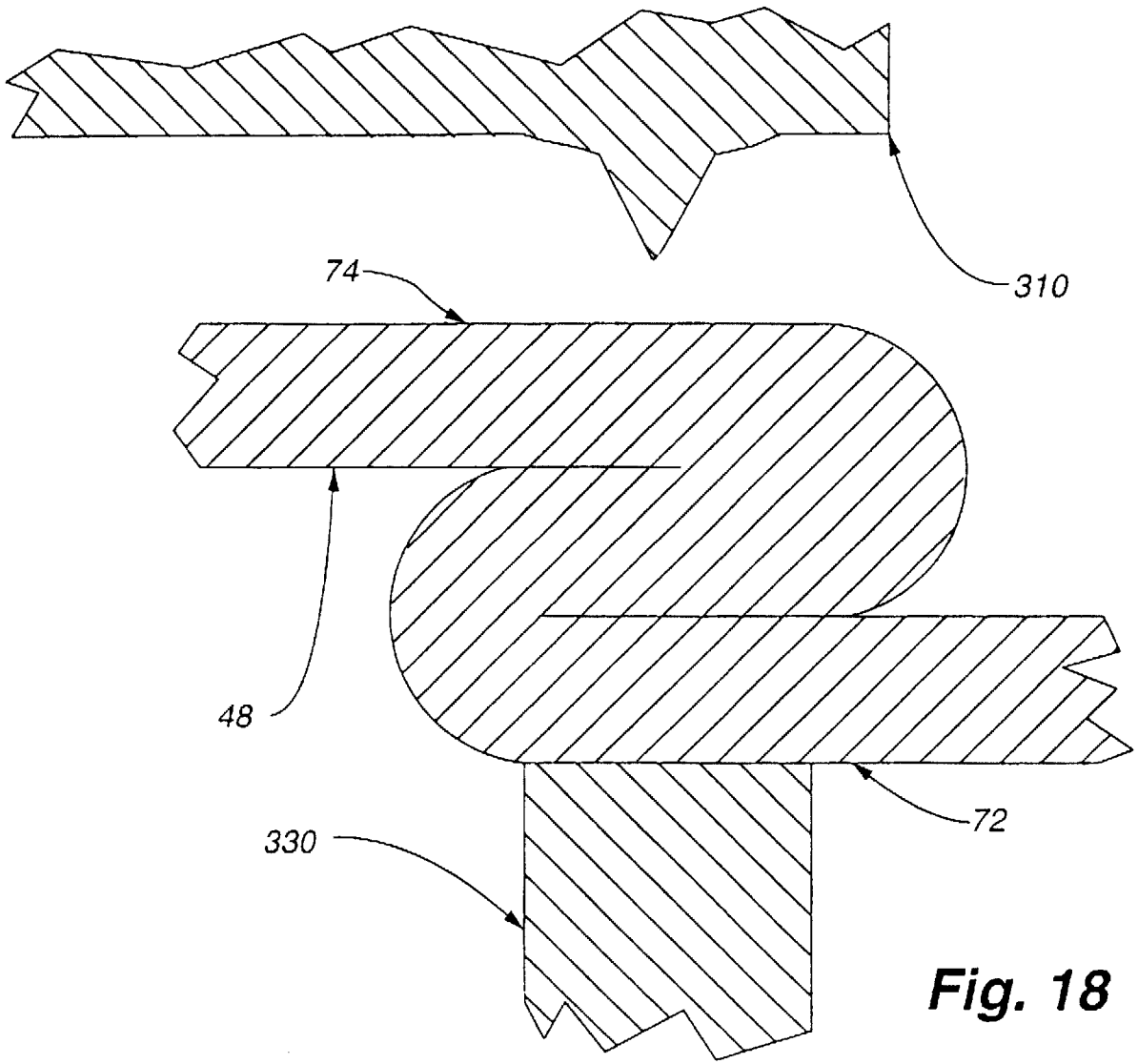
Figure 19:
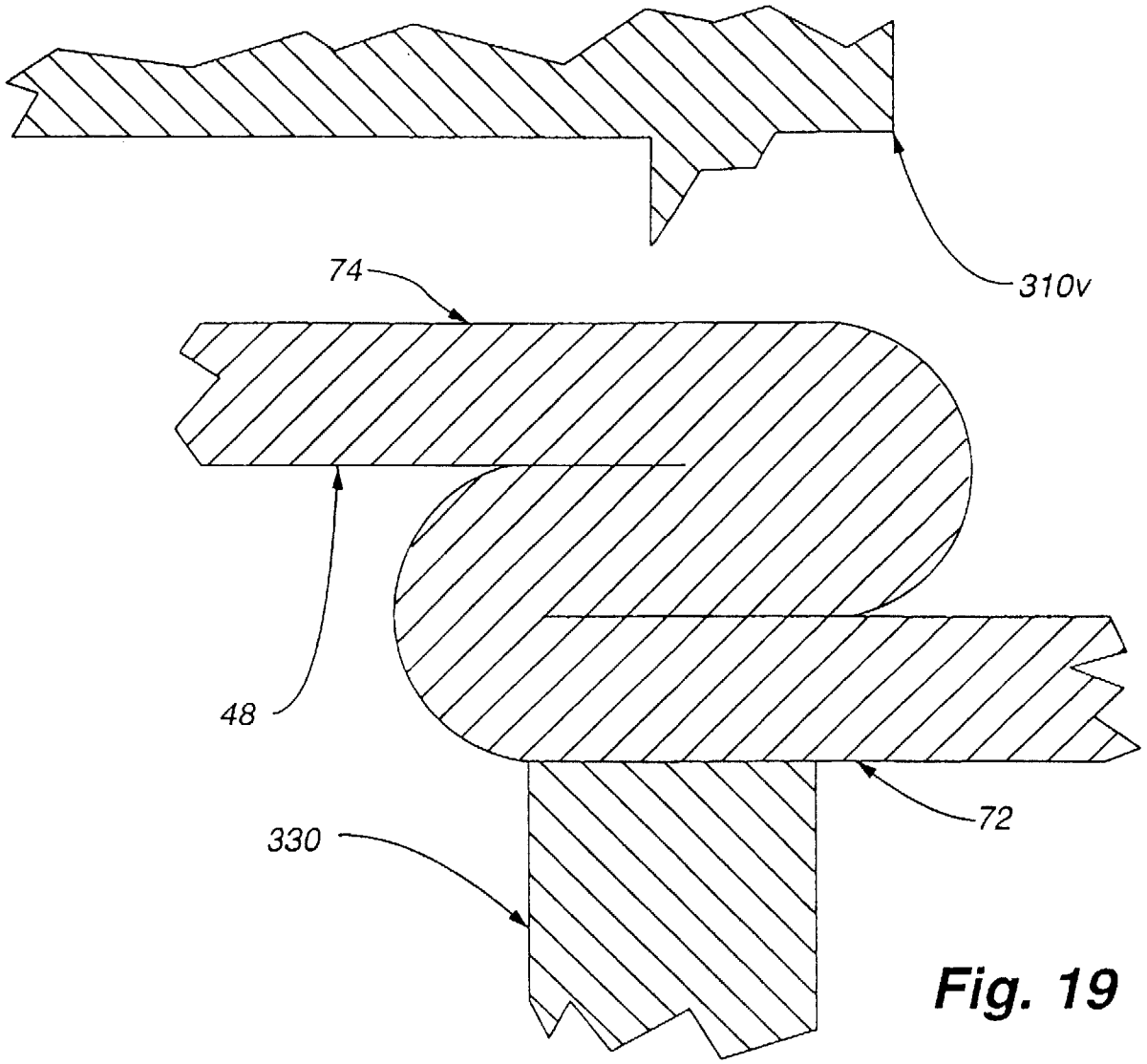
Figure 20:
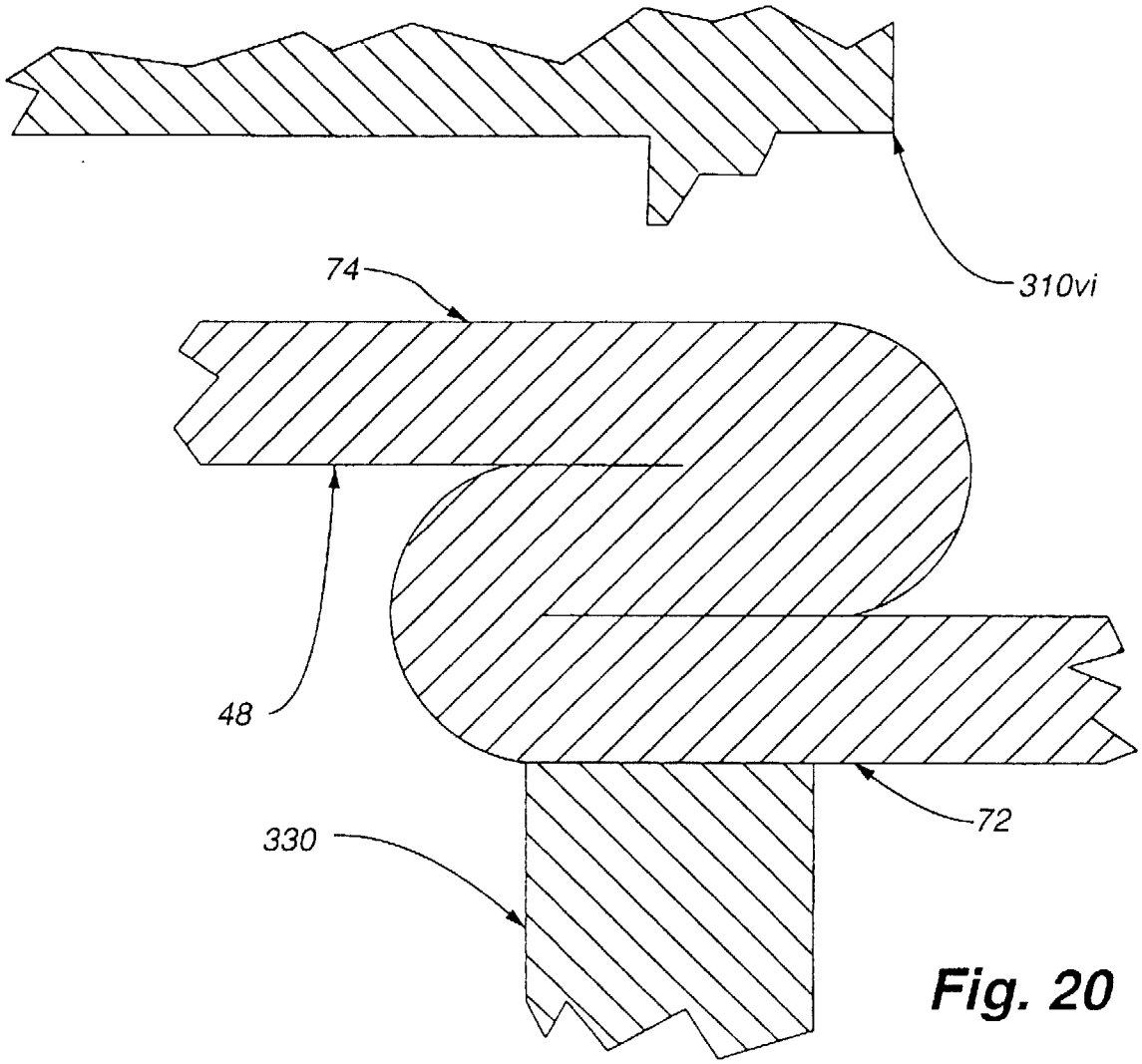
Figure 21:
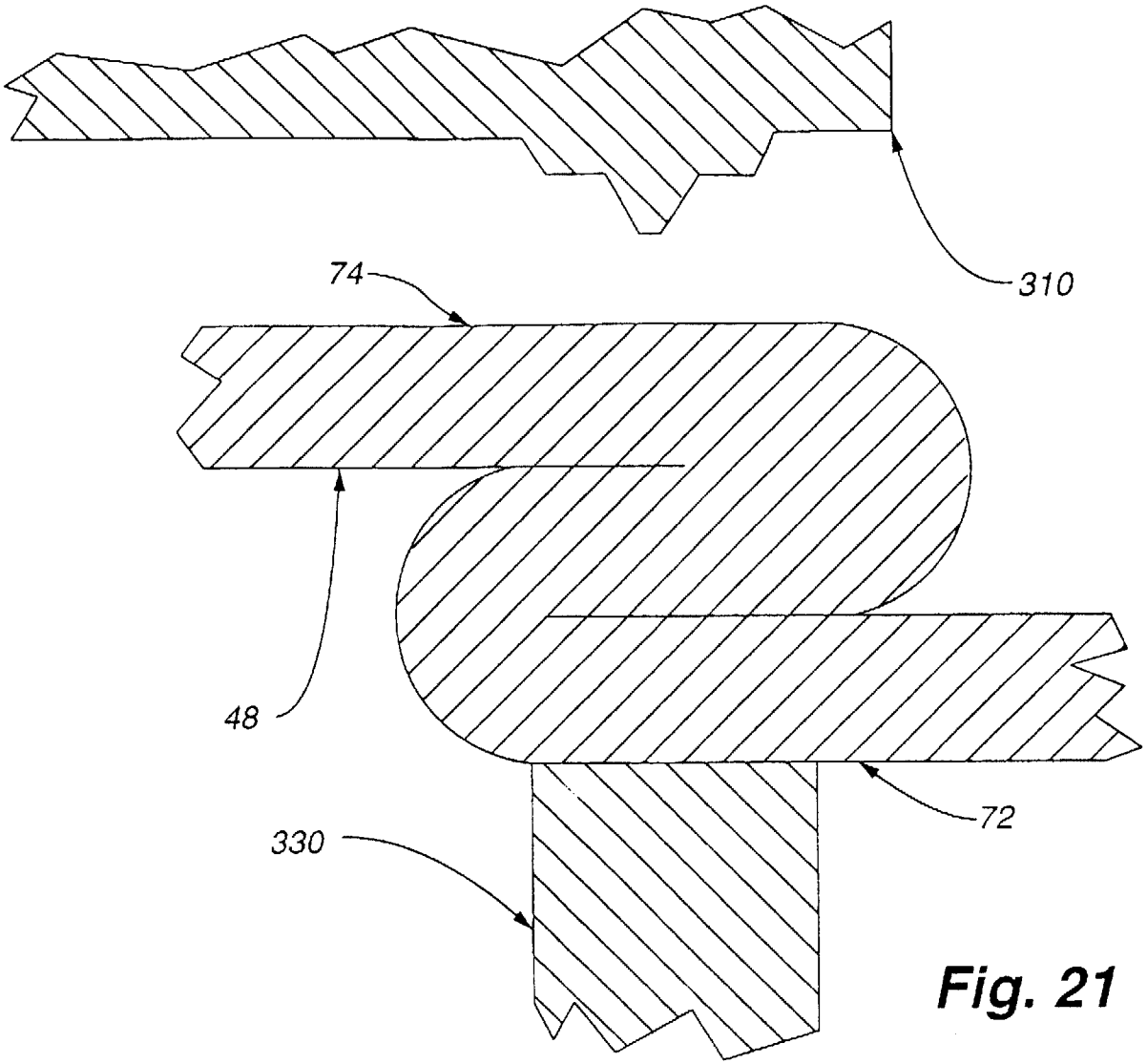

FIGS. 13A–13B illustrate one embodiment of an apparatus for scoring the end piece 100 to provide one or more of the above-discussed configurations for the score. The scoring apparatus generally comprises an annular scoring knife 310 for engaging the product side of the end piece 100 and an annular scoring anvil 330 for engaging the public side of the end piece 100 in an area generally opposite the scoring knife 310. In this regard, the scoring knife 310 engages the lower surface 66 of the end piece 100 about the product side surface 74 of the triple fold 70, while the scoring anvil 330 engages the public side surface 72 of the triple fold 70, substantially opposite the scoring knife 310, to facilitate scoring of the end piece 100 to define the opening panel 48. As shown in FIGS. 13A–13B, the scoring knife 310 may be moved relative to the scoring anvil 330 such that the scoring knife 310 contacts the product side surface 74 and scores the product side surface 74 to form the score 111 and the fracturable web 110.

Various alternative configurations for the scoring knife 310 are illustrated in FIGS. 14–21. The scoring knife 310$^{i}$ illustrated in FIG. 14 produces the score 170 illustrated in FIG. 10. The scoring knife 310$^{ii}$ illustrated in FIG. 15 produces the score 111 illustrated in FIG. 5. The scoring knife 310$^{iii}$ illustrated in FIG. 16 produces the score 111$^{ii}$ illustrated in FIG. 7. The scoring knife 310$^{iv}$ illustrated in FIG. 17 produces the score 111$^{ii}$ illustrated in FIG. 6. The scoring knife 310 illustrated in FIG. 18 produces the score 111$^{iii}$ illustrated in FIG. 8. The scoring knife 310$^{v}$ illustrated in FIG. 19 produces the score 170 illustrated in FIG. 9. The scoring knife 310$^{vi}$ illustrated in FIG. 20 produces the score 170$^{ii}$ illustrated in FIG. 11. The scoring knife 310$^{vii}$ illustrated in FIG. 21 produces the score 170$^{iii}$ illustrated in FIG. 12.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A container end piece attachable to an open end of a container body, comprising:

upper and lower surfaces;

an openable section in said end piece defined at least in part by a score on said lower surface, said openable section providing an aperture in said end piece when opened and said openable section having a centrally disposed, generally vertically extending first reference axis which is generally perpendicular with said end piece, said score comprising a first arcuately extending score section and a second arcuately extending score section, said second score section being disposed between said first score section and said lower surface of said end piece, said first score section comprising a first inner wall and a first outer wall relative to said first reference axis, said second annular score section comprising a second inner wall and a second outer wall relative to said first reference axis, wherein said end piece further comprises at least one discontinuity between said first outer wall and said second outer wall, wherein all portions of said second outer wall are disposed further from said first reference axis than all portions of said first outer wall;

a post repair material contained within at least a portion of said first score section, wherein at least a portion of said second score section provides a reservoir for said post repair material available for said first score section; and an opening assembly disposed on said upper surface of said end piece and associated with said openable section.

2. A container end piece, as claimed in claim 1, wherein said end piece further comprises a hinged portion integrally joining said openable section with a remainder of said end piece.

3. A container end piece, as claimed in claim 1, wherein said score is generally along an arc of a constant radius.

4. A container end piece, as claimed in claim 1, wherein said first outer wall of said first score section and said second outer wall of said second score section are each generally linearly extending and each have first and second ends, said first end of said first outer wall being disposed between said second end of said first outer wall and said upper surface of said end piece, said first end of said second outer wall being disposed between said second end of said second outer wall and said upper surface of said end piece, said first and second outer walls each extending generally away from said first reference axis progressing from said first end toward said second end, said second outer wall being disposed at an angle ranging from about 10° to about 30° relative to said first outer wall.

5. A container end piece, as claimed in claim 4, wherein said first inner wall of said first score section and said second inner wall of said second score section are each generally linearly extending and each have first and second ends, said first end of said first inner wall being disposed between said second end of said first inner wall and said upper surface of said end piece, said first end of said second inner wall being disposed between said second end of said second inner wall and said upper surface of said end piece, said first and second inner walls each extending generally toward said first reference axis progressing from said first end toward said second end, said second inner wall being disposed at an angle ranging from about 10° to about 30° relative to said first inner wall.

6. A container end piece, as claimed in claim 5, said score further comprising a first end section disposed substantially perpendicularly with said first reference axis, said first inner wall and said first outer wall extending from opposite ends of said end section toward said lower surface of said end piece.

7. A container end piece, as claimed in claim 4, wherein said first inner wall of said first score section and said first inner wall of said second score section are each linearly extending and collectively define a single linearly extending inner wall section for said score.

8. A container end piece, as claimed in claim 7, wherein said inner wall section is disposed substantially parallel with said first reference axis.

9. A container end piece, as claimed in claim 7, wherein said score further comprises a first end section, said first outer wall and said inner wall section extending from opposite ends of said first end section toward said lower surface of said end piece.

10. A container end piece, as claimed in claim 1, wherein a first surface of said first score section disposed closest to said upper surface of said end piece is oriented substantially perpendicular to said first reference axis.

11. A container end piece, as claimed in claim 10, wherein a width of said first surface of said first score section, taken perpendicularly to said arcuate extent of said first score section, ranges from about 0.001 inches to about 0.007 inches.

12. A container end piece, as claimed in claim 1, wherein a vertical extent of said second outer wall of said second score section is arcuate.

13. A container end piece, as claimed in claim 12, wherein said second outer wall is defined by a radius of at least about 0.005 inches.

14. A container end piece, as claimed in claim 1, wherein said first score section has a first score depth and said second score section has a second score depth, wherein a ratio of a sum of said first and second score depths to said second score depth ranges from about 9 to 1 to about 9 to 4.

15. A container end piece, as claimed in claim 1, wherein said discontinuity comprises an outer transition wall between said first outer wall of said first score section and said second outer wall of said second score section, wherein said outer transition wall has a different slope than that of each of said first outer wall and said second outer wall.

16. A container end piece, as claimed in claim 15, wherein said outer transition wall is disposed generally perpendicular to said first reference axis.

17. A container end piece, as claimed in claim 15, wherein said first inner wall and said second inner wall are each generally linearly extending and collectively define a generally linearly extending inner wall section.

18. A container end piece, as claimed in claim 17, wherein said score further comprises a first end section disposed substantially perpendicular to said first reference axis, said first outer wall and said inner wall section extending from opposite ends of said first end section toward said lower surface.

19. A container end piece, as claimed in claim 15, wherein said end piece further comprises an inner transition wall disposed between said first inner wall of said first score section and said first inner wall of said second score section, wherein said inner transition wall has a different slope than that of each of said first inner wall and said second inner wall.

20. A container end piece, as claimed in claim 19, wherein said score further comprises a first end section disposed substantially perpendicular to said first reference axis, said first outer wall and said first inner wall extending from opposite ends of said first end section toward said lower surface.

* * * * *